US010844810B2

(12) United States Patent
Yasuzaka et al.

(10) Patent No.: US 10,844,810 B2
(45) Date of Patent: Nov. 24, 2020

(54) LEAKAGE DETECTING DEVICE FOR VAPORIZED FUEL

(71) Applicant: DENSO CORPORATION, Kariya (JP)

(72) Inventors: Taiki Yasuzaka, Kariya (JP); Tomohiro Itoh, Kariya (JP)

(73) Assignee: DENSO CORPORATION, Kariya (JP)

( * ) Notice: Subject to any disclaimer, the term of this patent is extended or adjusted under 35 U.S.C. 154(b) by 52 days.

(21) Appl. No.: 16/385,031

(22) Filed: Apr. 16, 2019

(65) Prior Publication Data

US 2019/0353120 A1 Nov. 21, 2019

(30) Foreign Application Priority Data

May 21, 2018 (JP) ..... 2018-96800

(51) Int. Cl.
*F02M 25/08* (2006.01)

(52) U.S. Cl.
CPC .... *F02M 25/0809* (2013.01); *F02M 25/0836* (2013.01); *F02M 2025/0881* (2013.01)

(58) Field of Classification Search
CPC . F02M 25/08; F02M 25/0809; F02M 25/0836
See application file for complete search history.

(56) References Cited

U.S. PATENT DOCUMENTS 5,273,020 A * 12/1993 Hayami ..... F02M 25/08 123/516
5,957,113 A * 9/1999 Masaki ..... F02M 25/089 123/518
6,446,614 B1 * 9/2002 Matsuoka ..... F02D 29/06 123/516
6,478,849 B1 * 11/2002 Taylor ..... B01D 53/04 95/106
7,107,827 B2 * 9/2006 Kobayashi ..... F02M 25/0818 73/114.38
7,231,813 B2 * 6/2007 Kato ..... F02M 25/0836 73/40.5 R
7,284,530 B2 * 10/2007 Nagasaki ..... F02M 25/0818 123/198 D
7,350,399 B2 * 4/2008 Kobayashi ..... F02M 25/0818 73/49.7
8,770,013 B2 * 7/2014 Kato ..... G01M 3/3263 73/40.5 R
2004/0000187 A1 1/2004 Kobayashi et al.
2007/0214876 A1 * 9/2007 Miyahara ..... F02M 25/0809 73/114.39

* cited by examiner

*Primary Examiner* — Thomas N Moulis
(74) *Attorney, Agent, or Firm* — Nixon & Vanderhye P.C.

(57) ABSTRACT

A leakage detecting device includes a first sensor, a second sensor, a pump, a leakage determination portion and a determination resetting portion. The first sensor, which is provided in a first passage connecting a fuel tank to a canister, detects density of vaporized fuel generated in the fuel tank. The second sensor, which is provided in a third passage connecting the canister to the pump, detects pressure in the third passage. The pump is provided between the third passage and an atmospheric passage. The leakage determination portion determines whether there is leakage in a vaporized fuel processing system or not, based on a time-variable amount of the pressure detected by the second sensor. The determination resetting portion resets a leakage determination result of the leakage determination portion, based on a time-variable amount of the density and the time-variable amount of the pressure.

14 Claims, 20 Drawing Sheets

FIG. 3

FIRST RESET DETERMINATION CHART (Pc < Pb : THERE IS NO LEAKAGE)

| TIME-VARIABLE AMOUNT OF DENSITY | DETERMINATION BY THE DETERMINATION RESETTING PORTION 22 | ACTION BY THE DETERMINATION RESETTING PORTION 22 |
|---|---|---|
| DA-1 (IN CASE OF CE(2)) LARGER THAN UPPER-LIMIT VALUE "THu" | THE OUTPUT OF THE FIRST SENSOR OR THE SECOND SENSOR MAY BE ABNORMAL. | THE DETERMINATION RESULT (NO LEAKAGE) OF THE LEAKAGE DETERMINATION PORTION 21 IS CANCELLED. A DIAGNOSING LAMP IS TURNED ON, WHEN THE DETERMINATION RESULT IS REPEATEDLY CANCELLED. |
| DA-2 (IN CASE OF CE(1)) BETWEEN "THu" AND "THl" | THE OUTPUT OF THE FIRST SENSOR IS NORMAL. (THE DETERMINATION OF NO-LEAKAGE CONDITION IS NORMALLY DONE) | THE DETERMINATION RESULT (NO LEAKAGE) OF THE LEAKAGE DETERMINATION PORTION 21 IS MAINTAINED. |
| DA-3 (IN CASE OF CE(3)) SMALLER THAN LOWER-LIMIT VALUE "THl" | THERE IS A HOLE SMALLER THAN A PREDETERMINED SIZE. | THE DETERMINATION RESULT (NO LEAKAGE) OF THE LEAKAGE DETERMINATION PORTION 21 IS CANCELLED. A DIAGNOSING LAMP IS TURNED ON, WHEN THE DETERMINATION RESULT IS REPEATEDLY CANCELLED. |

FIG. 4

SECOND RESET DETERMINATION CHART (Pc ≥ Pb : THERE IS LEAKAGE)

| TIME-VARIABLE AMOUNT OF DENSITY | DETERMINATION BY THE DETERMINATION RESETTING PORTION 22 | ACTION BY THE DETERMINATION RESETTING PORTION 22 |
|---|---|---|
| DA-4 (IN CASE OF CE(2)) LARGER THAN UPPER-LIMIT VALUE "THu" | THE LEAKAGE DETERMINATION ACCURACY IS POSSIBLY DECREASED DUE TO AN UNSTABLE OPERATION OF THE VAPORIZED FUEL PROCESSING SYSTEM. | THE DETERMINATION RESULT (THERE IS THE LEAKAGE) OF THE LEAKAGE DETERMINATION PORTION 21 IS CANCELLED. |
| DA-5 (IN CASE OF CE(1)) BETWEEN "THu" AND "THl" | THE OUTPUT OF THE FIRST SENSOR IS NORMAL. (THE DETERMINATION FOR THE LEAKAGE CONDITION IS NORMALLY DONE) | THE DETERMINATION RESULT (THERE IS THE LEAKAGE) OF THE LEAKAGE DETERMINATION PORTION 21 IS MAINTAINED. |
| DA-5 (IN CASE OF CE(3)) SMALLER THAN LOWER-LIMIT VALUE "THl" | THE OUTPUT OF THE FIRST SENSOR IS NORMAL. (THE DETERMINATION FOR THE LEAKAGE CONDITION IS NORMALLY DONE) | THE DETERMINATION RESULT (THERE IS THE LEAKAGE) OF THE LEAKAGE DETERMINATION PORTION 21 IS MAINTAINED. |

LEAKAGE DETECTING DEVICE FOR VAPORIZED FUEL

CROSS REFERENCE TO RELATED APPLICATION

This application is based on Japanese Patent Application No. 2018-96800 filed on May 21, 2018, the disclosure of which is incorporated herein by reference.

FIELD OF TECHNOLOGY

The present disclosure relates to a leakage detecting device for vaporized fuel, which is, for example, applied to a vaporized fuel processing system for an automotive vehicle.

BACKGROUND

A vaporized fuel processing system is known in the art, according to which fuel vapor generated in a fuel tank for an automotive vehicle is collected in a canister and the fuel vapor is supplied from the canister to an internal combustion engine (hereinafter, the engine) by controlling a purge valve device. A leakage detecting device for the fuel vapor according to one of prior arts detects a leakage of the fuel vapor generated in the fuel tank in the following manner. A pressure difference is produced between an inside of the fuel tank and an outside of the fuel tank and the leakage of the fuel vapor from the fuel tank is detected based on a pressure in a fuel vapor passage connected to the fuel tank.

In the leakage detecting device of the above prior art, a leakage determination process for the fuel vapor is carried out when a predetermined time has passed by after an operation of the engine is stopped. High detection accuracy can be obtained when the leakage determination process is carried out after the temperature of the automotive vehicle becomes stable.

SUMMARY OF THE DISCLOSURE

The present disclosure is made in view of the above point. It is an object of the present disclosure to provide a leakage detecting device for vaporized fuel, according to which high detection accuracy for a leakage determination process can be obtained while a range of operating conditions of an internal combustion engine and/or an automotive vehicle for carrying out the leakage determination process can be broadened.

According to one of features of the present disclosure, a leakage detecting device for vaporized fuel includes a first sensor, a pump, a second sensor, a leakage determination portion and a determination resetting portion. The first sensor detects a first physical amount (for example, density of vaporized fuel) of a gas in a position at which the first sensor is provided. The second sensor detects a second physical amount (for example, pressure of a gas containing the vaporized fuel) of a gas in a position at which the second sensor is provided.

The leakage determination portion determines whether there is leakage of vaporized fuel in a vaporized fuel processing system or not, based on a time-variable amount of the second physical amount. The determination resetting portion resets a leakage determination result made by the leakage determination portion or resets a leakage determination process to be carried out by the leakage determination portion, based on the time-variable amount of the second physical amount and the time-variable amount of the first physical amount.

The term "to reset the leakage determination result or to reset the leakage determination process" includes "to cancel the leakage determination result made by the leakage determination portion" or "to stop the leakage determination process to be carried out by the leakage determination portion".

BRIEF DESCRIPTION OF THE DRAWINGS

The above and other objects, features and advantages of the present disclosure will become more apparent from the following detailed description made with reference to the accompanying drawings. In the drawings:

FIG. 3 is a first reset determination chart, which is used for resetting a leakage determination result made by a leakage determination portion of the first embodiment, in a case that there is no leakage of the vaporized fuel;

FIG. 4 is a second reset determination chart, which is used for resetting the leakage determination result made by the leakage determination portion of the first embodiment, in a case that there is leakage of the vaporized fuel;

DETAILED DESCRIPTION OF THE EMBODIMENTS

Figure 1:
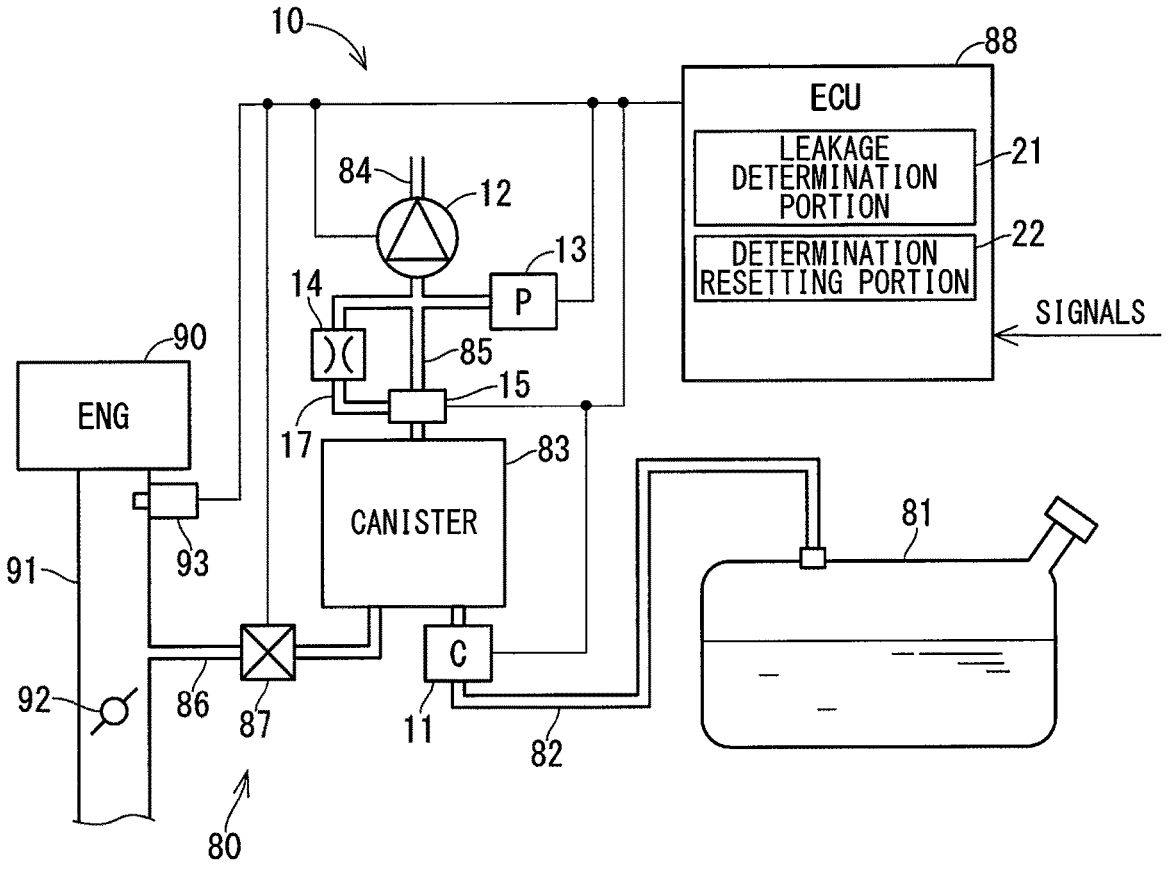
FIG. 1 is a schematic diagram of a leakage detecting device for vaporized fuel according to a first embodiment of the present disclosure, which is applied to a vaporized fuel processing system for an automotive vehicle.

The present disclosure will be explained hereinafter by way of multiple embodiments and/or modifications with reference to the drawings. The same reference numerals are given to the same or similar structures and/or portions in order to avoid repeated explanation.

First Embodiment

A leakage detecting device 10 for vaporized fuel according to a first embodiment of the present disclosure is applied to a vaporized fuel processing system 80 shown in FIG. 1. The vaporized fuel processing system 80 includes a fuel tank 81 mounted in an automotive vehicle (including a hybrid vehicle), a vaporized fuel collecting passage 82 (also referred to as "a first passage"), a canister 83 connected to the fuel tank 81 via the vaporized fuel collecting passage 82, a connecting passage 85 (also referred to as "a third passage") connecting the canister 83 to an atmospheric passage 84, a purge passage 86 (also referred to as "a second passage") connecting the canister 83 to an intake air pipe 91 of an internal combustion engine 90 (hereinafter, the engine 90), a purge valve device 87 provided in the purge passage 86, and so on.

The canister 83 includes absorbent material (not shown). The absorbent material is, for example, activated carbon, which absorbs vaporized fuel generated in the fuel tank 81. The purge valve device 87 is controlled by an electronic control unit 88 (hereinafter, the ECU 88). Air is sucked from the canister 83 into the intake air pipe 91 by negative pressure generated in the intake air pipe 91, during the engine 90 is operated. The atmospheric air flows into the canister 83 via the atmospheric passage 84. When the atmospheric air flows through the canister 83, the vaporized fuel absorbed in the absorbent material is discharged from the absorbent material. The vaporized fuel discharged from the absorbent material of the canister 83 is mixed with the air passing through a throttle valve 92 and fuel injected from a fuel injection valve 93, so that such mixture of the air and the fuel is supplied into each of combustion chambers of the engine 90 and burnt therein.

The leakage detecting device 10 for the vaporized fuel will be hereinafter explained. The leakage detecting device 10 includes a first sensor 11, a pump 12, a second sensor 13, an orifice 14, a passage switching valve 15, the ECU 88 and so on. The ECU 88 includes not only a control portion for the vaporized fuel processing system 80 but also a control portion for the leakage detecting device 10 for the vaporized fuel.

The first sensor 11 is provided in the vaporized fuel collecting passage 82 (the first passage) connecting the fuel tank 81 to the canister 83. The first sensor 11 detects density of the vaporized fuel as a first physical amount for a gas surrounding the first sensor 11. More exactly, the first sensor 11 is a density sensor for detecting the density of the vaporized fuel contained in the gas located in a specific position of the vaporized fuel collecting passage 82. In the present embodiment, the first sensor 11 is located at a position neighboring to the canister 83. The first sensor 11 detects the first physical amount related to the gas existing in the position, at which the first sensor 11 is provided. Hereinafter, "the density" means the density of the vaporized fuel as the first physical amount.

The pump 12 is provided at a position of a passage from the canister 83 to the atmospheric passage 84, that is, at a position between the connecting passage 85 (the third passage) and the atmospheric passage 84. In addition to the connecting passage 85, the pump 12 is further connected to the canister 83 via a restricted passage 17, which is divided from the connecting passage 85 and joins up again with the connecting passage 85. The pump 12 decreases pressure in the fuel tank 81, when it is rotated in a forward direction. The pump 12 increases the pressure in the fuel tank 81, when it is rotated in a backward direction.

The second sensor 13 is provided in the connecting passage 85 at a position between the canister 83 and the pump 12. The second sensor 13 detects pressure of a gas as a second physical amount for the gas surrounding the second sensor 13. More exactly, the second sensor 13 is a pressure sensor for detecting the pressure of the gas containing the vaporized fuel and located in a specific position of the connecting passage 85. The second sensor 13 detects the second physical amount related to the gas existing in the position, at which the second sensor 13 is provided. Hereinafter, "the pressure" means the pressure of the gas containing the vaporized fuel as the second physical amount.

The orifice 14 is provided in the restricted passage 17. The passage switching valve 15 is located at a position, at which a passage from the canister 83 is divided into the connecting passage 85 and the restricted passage 17. The passage switching valve 15 switches over a passage condition from a first passage condition to a second passage condition, or vice versa. In the first passage condition, the canister 83 is connected to the pump 12 via the connecting passage 85. In the second passage condition, the canister 83 is connected to the pump 12 via the restricted passage 17. In the first passage condition, the passage switching valve 15 is in an OFF condition. In the second passage condition, the passage switching valve 15 is in an ON condition.

The ECU 88 includes a leakage determination portion 21 and a determination resetting portion 22, which have collectively functions for detecting the leakage of the vaporized fuel in the vaporized fuel processing system 80 and for resetting a leakage determination result.

The leakage determination portion 21 determines whether there is the leakage of the vaporized fuel in the vaporized fuel processing system 80 or not, based on a time-variable amount of the pressure (the second physical amount). More exactly, the leakage determination portion 21 carries out the following steps (a1) to (a5) in its leakage determination process;

(a1) a determination whether the leakage determination process is started or not;

(a2) a measurement of the atmospheric pressure;

(a3) a measurement of a reference pressure;

(a4) a measurement of a system pressure (a pressure in the vaporized fuel processing system); and (a5) a determination for the leakage of the vaporized fuel.

In the above step (a1), the leakage determination portion 21 determines whether each of travelling parameters of the automotive vehicle is respectively within a predetermined range or not. The leakage determination portion 21 starts the leakage determination process, when the travelling parameters are in the respective predetermined ranges. The travelling parameters include, for example, a travelling time, an average vehicle speed, a temperature of engine cooling water and so on. In the present embodiment, the leakage determination portion 21 starts the leakage determination process when the following conditions (b1) to (b3) are satisfied;

(b1) the travelling time is longer than a predetermined travelling time;

(b2) the average vehicle speed is higher than a predetermined average vehicle speed; and (b3) the temperature of the engine cooling water is higher than a predetermined temperature.

Figure 2:
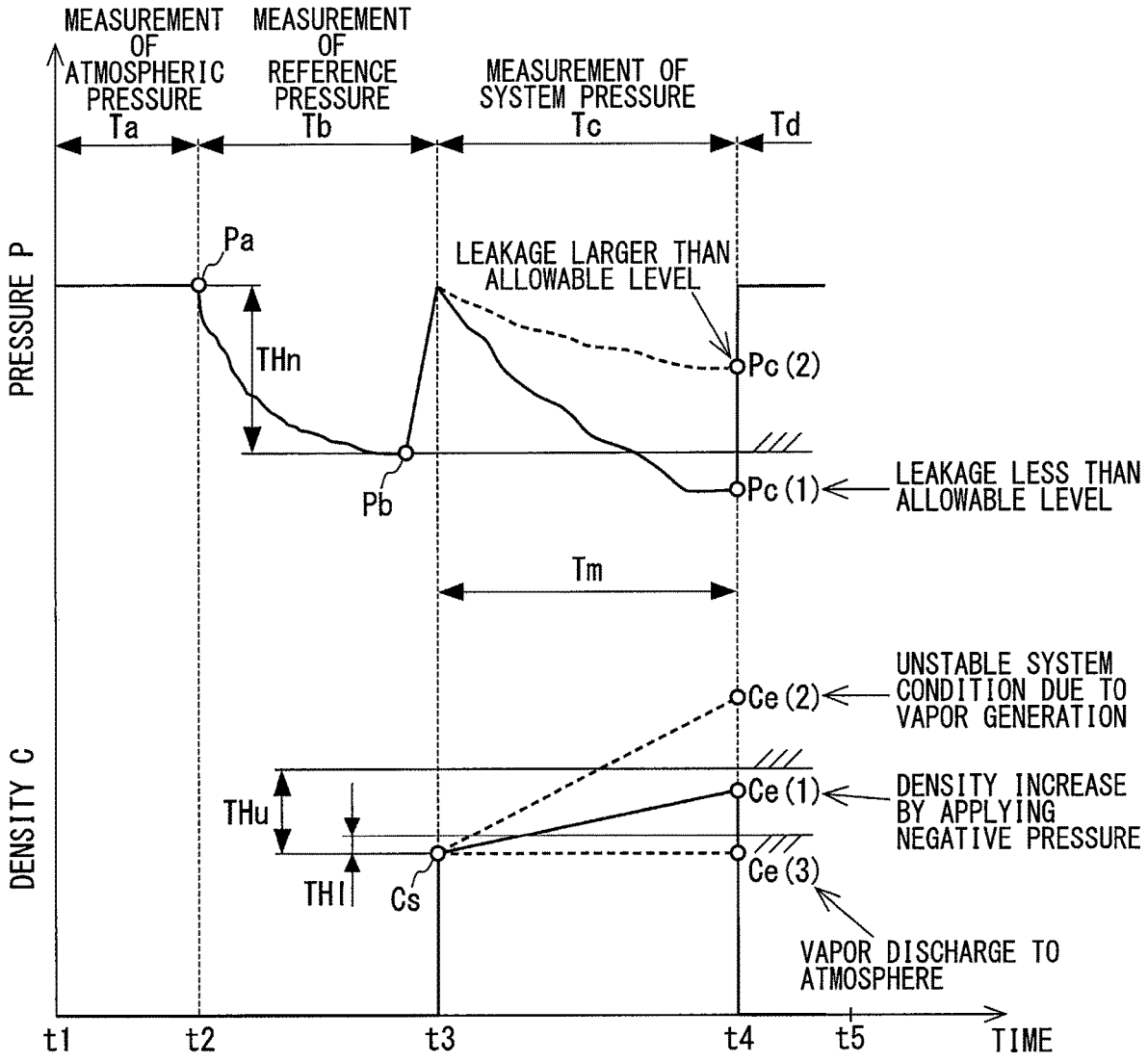
FIG. 2 is a time-chart showing changes of pressure and density of a gas containing vaporized fuel in a leakage determination process according to the first embodiment.

The leakage determination portion 21 measures the atmospheric pressure "Pa" by the second sensor 13, at a step immediately after starting the leakage determination process. In this step, the pump 12 and the passage switching valve 15 are in the OFF condition. In FIG. 2, a period "Ta" from a timing "t1" to a timing "t2" is a period for measuring the atmospheric pressure "Pa".

Referring back to FIG. 1, the leakage determination portion 21 measures the reference pressure "Pb" by the second sensor 13, at a step after the measuring step for the atmospheric pressure "Pa". The leakage determination portion 21 memorizes the detected pressure as the reference pressure "Pb", when the passage switching valve 15 is in the ON condition and the pump 12 is rotated in the forward direction and when the pressure is restored to a constant value. Each of the pump 12 and the passage switching valve 15 is turned to the OFF condition, after completing the measuring step for the reference pressure "Pb". The leakage determination portion 21 holds its condition until the detected pressure returns to the atmospheric pressure "Pa". In FIG. 2, a period "Tb" from the timing "t2" to a timing "t3" is a period for measuring the reference pressure "Pb".

As shown in FIG. 1, the leakage determination portion 21 measures the system pressure "Pc" based on the detection of the second sensor 13, after the measurement of the reference pressure "Pb". The leakage determination portion 21 memorizes the detected pressure as the system pressure "Pc", which is measured when a predetermined measuring time "Tm" elapses in a condition that the passage switching valve 15 is in the OFF condition and the pump 12 is rotated in the forward direction. The pump 12 is turned to the OFF condition while the passage switching valve 15 is maintained in the OFF condition, after the measurement of the system pressure "Pc" is completed. In FIG. 2, a period "Tc" from the timing "t3" to a timing "t4" is a period for measuring the system pressure "Pc".

When the system pressure "Pc=Pc(1)" is lower than the reference pressure "Pb", a leakage amount of the vaporized fuel is smaller than an allowable level. Therefore, the leakage determination portion 21 determines that there is no leakage of the vaporized fuel in the vaporized fuel processing system 80. In the case that the system pressure "Pc=Pc(1)" is lower than the reference pressure "Pb", it corresponds to a condition that a time-variable amount of the pressure in the measuring time "Tm" is larger than a threshold value "THn" for a no-leakage condition. The threshold value "THn" for the no-leakage condition is a value, which is obtained by subtracting the reference pressure "Pb" from the atmospheric pressure "Pa".

When the system pressure "Pc=Pc(2)" is higher than the reference pressure "Pb", the leakage amount of the vaporized fuel is larger than the allowable level. Therefore, the leakage determination portion 21 determines that there is the leakage of the vaporized fuel in the vaporized fuel processing system 80. In the case that the system pressure "Pc=Pc(2)" is higher than the reference pressure "Pb", it corresponds to a condition that the time-variable amount of the pressure in the measuring time "Tm" is smaller than the threshold value "THn" for the no-leakage condition. The leakage determination portion 21 turns the second sensor 13 to its OFF condition and terminates the leakage determination process, after it confirms that the pressure returned to the atmospheric pressure "Pa". In FIG. 2, a period "Td" from the timing "t4" to a timing "t5" is a period for determining whether there is the leakage of the vaporized fuel or not in the vaporized fuel processing system 80.

The determination resetting portion 22 of the ECU 88 (shown in FIG. 1) resets (more exactly, cancels) a leakage determination result ("there is the leakage" or "there is no leakage") made by the leakage determination portion 21, based on the time-variable amount of the density and the time-variable amount of the pressure. In the case that the system pressure "Pc=Pc(1)" is smaller than the reference pressure "Pb", namely in the case that the time-variable amount of the pressure in the measuring time "Tm" is larger than the threshold value "THn" for the no-leakage condition (that is, in the case of no leakage of the vaporized fuel), the determination resetting portion 22 carries out the following determinations and actions (DA-1) to (DA-3) depending on the time-variable amount of the density in accordance with a first reset determination chart shown in FIG. 3. The time-variable amount of the density is an amount of change of the density in the measuring time "Tm". In other words, the time-variable amount of the density is an absolute value of a difference between a start density "Cs" and an end density "Ce". The start density "Cs" is a value of the density at a starting point of the measuring time "Tm" for the system pressure "Pc". The end density "Ce" is a value of the density at an ending point of the measuring time "Tm" for the system pressure "Pc".

(DA-1) In a case (Ce(2)) that the time-variable amount of the density is larger than an upper-limit value "THu" for density determination, the determination resetting portion 22 determines that an output of the first sensor 11 (the density sensor 11) or the second sensor 13 (the pressure sensor 13) may be abnormal and cancels the leakage determination result (the determination of no leakage of the vaporized fuel) made by the leakage determination portion 21.

(DA-2) In a case (Ce(1)) that the time-variable amount of the density is smaller than the upper-limit value "THu" for the density determination but larger than a lower-limit value "THl" for the density determination, the determination resetting portion 22 determines that the output of the first sensor 11 is normal and maintains the leakage determination result (the determination of no leakage of the vaporized fuel) made by the leakage determination portion 21.

(DA-3) In a case (Ce(3)) that the time-variable amount of the density is smaller the lower-limit value "THl" for the density determination, the determination resetting portion 22 determines that there is a hole smaller than a predetermined size and cancels the leakage determination result (the determination of no leakage of the vaporized fuel) made by the leakage determination portion 21.

In a case that the system pressure "Pc=Pc(2)" is higher than the reference pressure "Pb", namely in the case that the time-variable amount of the pressure in the measuring time "Tm" is smaller than the threshold value "THn" for the no-leakage condition (that is, in the case of the leakage of the vaporized fuel), the determination resetting portion 22 carries out the following determinations and actions (DA-4) and (DA-5) depending on the time-variable amount of the density in accordance with a second reset determination chart shown in FIG. 4. In the second reset determination chart of FIG. 4, although the time-variable amount of the density is divided into three cases (larger than "THu", between "THu" and "THl", and smaller than "THl"), the determination and action for the second case (between "THu" and "THl") and the determination and action for the third case (smaller than "THl") are the same to each other.

(DA-4) In the case (Ce(2)) that the time-variable amount of the density is larger than the upper-limit value "THu" for the density determination, the determination resetting portion 22 determines that the determination accuracy for the leakage of the vaporized fuel may be decreased due to an unstable operation of the vaporized fuel processing system 80. The determination resetting portion 22 cancels the leakage determination result (there is the leakage) made by the leakage determination portion 21.

(DA-5) In the case (Ce(1) or Ce(3)) that the time-variable amount of the density is smaller than the upper-limit value "THu" for the density determination, the determination resetting portion 22 determines that the leakage determination process of the leakage determination portion 21 is normally done and thereby the determination resetting portion 22 maintains the leakage determination result (there is the leakage) made by the leakage determination portion 21.

Each function and/or step of the leakage determination portion 21 and the determination resetting portion 22 of the ECU 88 may be carried out by hardware processes of dedicated logic circuits or by software processes, wherein programs memorized in memory devices (for example, read-only memories) are implemented by CPU. Alternatively, the above functions and/or steps of the ECU 88 may be carried out by a combination of the hardware processes and the software processes. It may be selectively decided which function(s) and/or step(s) of the leakage determination portion 21 and the determination resetting portion 22 are realized by the hardware processes or the software processes.

(Process Implemented by ECU)

A process implemented by the ECU 88 for detecting the leakage of the vaporized fuel will be explained with reference to FIG. 5. A main routine of FIG. 5 is repeatedly carried out from a time when an operation for the automotive vehicle is started until a time when the operation thereof is ended.

Figure 5:
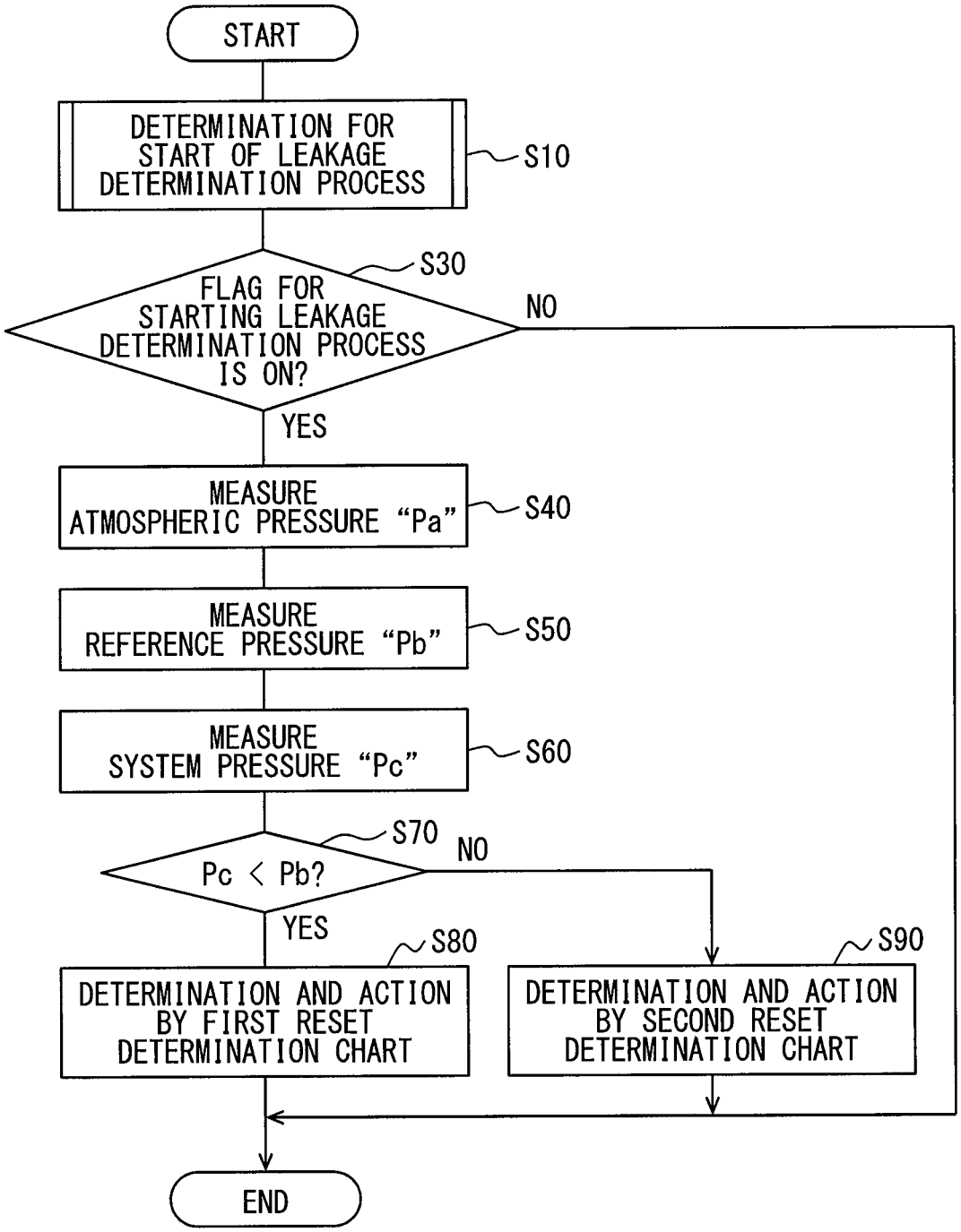
FIG. 5 is a flow-chart of a main routine showing a leakage determination and resetting process to be carried out by an electronic control unit of the first embodiment.
Figure 6:
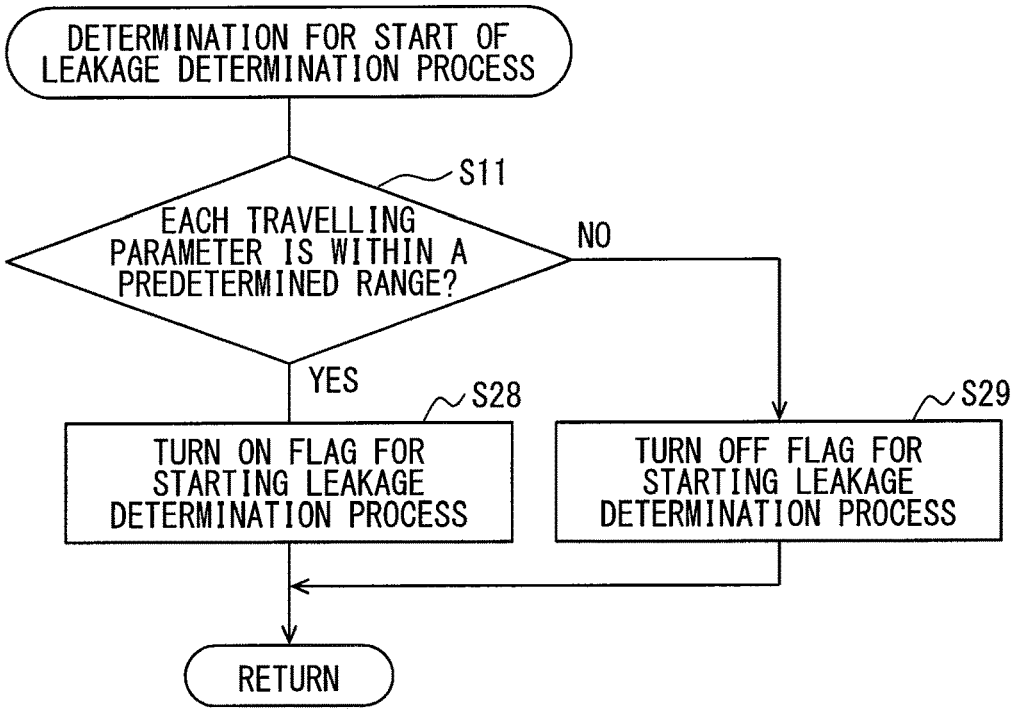
FIG. 6 is a flow-chart of a sub-routine showing a process for determining whether the leakage determination and resetting process is started or not.

At a step S10 of the main routine shown in FIG. 5, a sub-routine of FIG. 6 is read out and the sub-routine is carried out for determining whether the leakage determination process is started or not.

At a step S11 of the sub-routine shown in FIG. 6, the ECU 88 determines whether each of the travelling parameters of the automotive vehicle is respectively within the predetermined range or not. When the following three conditions (b1) to (b3) are satisfied, the ECU 88 determines that the travelling parameters are within the respective predetermined ranges (YES at the step S11):

(b1) the travelling time is longer than the predetermined travelling time;

(b2) the average vehicle speed is higher than the predetermined average vehicle speed; and (b3) the temperature of the engine cooling water is higher than the predetermined temperature.

Then, the process goes to a step S28. When one of the following conditions (b4) to (b6) is satisfied, the ECU 88 determines that the travelling parameters are not within the predetermined ranges (NO at the step S11):

(b4) the travelling time is shorter than the predetermined travelling time;

(b5) the average vehicle speed is lower than the predetermined average vehicle speed; or (b6) the temperature of the engine cooling water is lower than the predetermined temperature.

Then, the process goes to a step S29.

At the step S28 of FIG. 6, a flag for starting the leakage determination process is turned ON. The process of FIG. 6 goes back to the step S10 of the main routine of FIG. 5, after the step S28.

At the step S29 of FIG. 6, the flag for starting the leakage determination process is turned OFF. The process of FIG. 6 goes back to the step S10 of the main routine of FIG. 5, after the step S29.

At a step S30 of FIG. 5, the ECU 88 determines whether the flag for starting the leakage determination process is turned ON or not. In a case that the flag for starting the leakage determination process is ON (YES at the step S30), the process goes to a step S40. In a case that the flag for starting the leakage determination process is not ON but OFF (NO at the step S30), the process goes to an end.

At the step S40, the ECU 88 measures the atmospheric pressure "Pa" by use of a signal from the second sensor 13. The process goes on to a step S50 after the step S40.

At the step S50, the ECU 88 measures the reference pressure "Pb" by use of the signal from the second sensor 13. The process goes on to a step S60 after the step S50.

At the step S60, the ECU 88 measures the system pressure "Pc" by use of the signal from the second sensor 13. The process goes on to a step S70 after the step S60.

At the step S70, the ECU 88 determines whether the system pressure "Pc" is lower than the reference pressure "Pb" or not. In a case that the system pressure "Pc" is lower than the reference pressure "Pb", that is, in the case that there is no leakage of the vaporized fuel (YES at the step S70), the process goes to a step S80. On the other hand, in a case that the system pressure "Pc" is not lower than the reference pressure "Pb", that is, in the case that there is the leakage of the vaporized fuel (NO at the step S70), the process goes to a step S90.

At the step S80, the ECU 88 carries out one of the above explained determinations and actions (DA-1) to (DA-3) in accordance with the first reset determination chart shown in FIG. 3, depending on the time-variable amount of the density. The process goes to the end after the step S80.

At the step S90, the ECU 88 carries out one of the above explained determinations and actions (DA-4) to (DA-5) in accordance with the second reset determination chart shown in FIG. 4, depending on the time-variable amount of the density. The process goes to the end after the step S90.

(Advantages)

As above, the leakage detecting device 10 for the vaporized fuel according to the first embodiment includes the first sensor 11, the pump 12, the second sensor 13, the leakage determination portion 21 and the determination resetting portion 22. The first sensor 11 is provided in the vaporized fuel collecting passage 82 (the first passage) between the fuel tank 81 and the canister 83 for detecting the density of the vaporized fuel as the first physical amount, which is related to the gas in the place at which the first sensor 11 is provided. The pump 12 is provided in the connecting passage 85 (the third passage) between the canister 83 and the atmospheric passage 84. The second sensor 13 is provided in the connecting passage 85 at a position between the canister 83 and the pump 12 for detecting the pressure as the second physical amount, which is related to the gas in the place at which the second sensor 13 is provided.

The leakage determination portion 21 determines whether there is the leakage of the vaporized fuel in the vaporized fuel processing system 80 or not, based on the time-variable amount of the pressure. The determination resetting portion 22 resets (cancels) the leakage determination result made by the leakage determination portion 21, based on the time-variable amount of the density and the time-variable amount of the pressure (in accordance with the first and the second reset determination charts). As a result, it is possible to obtain the determination result for the leakage of the vaporized fuel, which is high in the detection accuracy for the leakage of the vaporized fuel. Accordingly, it is possible to implement the leakage determination process without waiting for a predetermined time after the engine operation is stopped. According to the leakage detecting device 10 for the vaporized fuel, it is possible to maintain the high detection accuracy for the leakage of the vaporized fuel and to expand the range of the operating conditions of the engine and/or the automotive vehicle for implementing the leakage determination process.

In addition, according to the first embodiment, the determination resetting portion 22 cancels the leakage determination result made by the leakage determination portion 21, when the time-variable amount of the pressure (Pc(1)) is larger than the threshold value "THn" for the no-leakage condition and when the time-variable amount of the density (Ce(2)) is larger than the upper-limit value "THu" for the density determination or smaller than the lower-limit value "THl" for the density determination. Furthermore, the determination resetting portion 22 cancels the leakage determination result made by the leakage determination portion 21, when the time-variable amount of the pressure (Pc(2)) is smaller than the threshold value "THn" for the no-leakage condition and when the time-variable amount of the density (Ce(2)) is larger than the upper-limit value "THu" for the density determination. Accordingly, it is possible to obtain the leakage determination result, which is high in the detection accuracy for the vaporized fuel in the vaporized fuel processing system 80.

In the present embodiment, the density of the vaporized fuel is used as the first physical amount. It is, thereby, possible to confirm usability of the leakage determination result for the leakage of the vaporized fuel.

In the first embodiment, the leakage detecting device 10 for the vaporized fuel includes the orifice 14 provided in the restricted passage 17, the passage switching valve 15 and so on. The passage switching valve 15 switches over the passage condition from the first passage condition to the second passage condition, or vice versa. In the first passage condition, the canister 83 is connected to the pump 12 via the connecting passage 85, while in the second passage condition, the canister 83 is connected to the pump 12 via the restricted passage 17. The leakage determination process is thereby carried out based on the reference pressure "Pb" and the detection accuracy for the leakage determination process can be increased.

Second Embodiment

Figure 7:
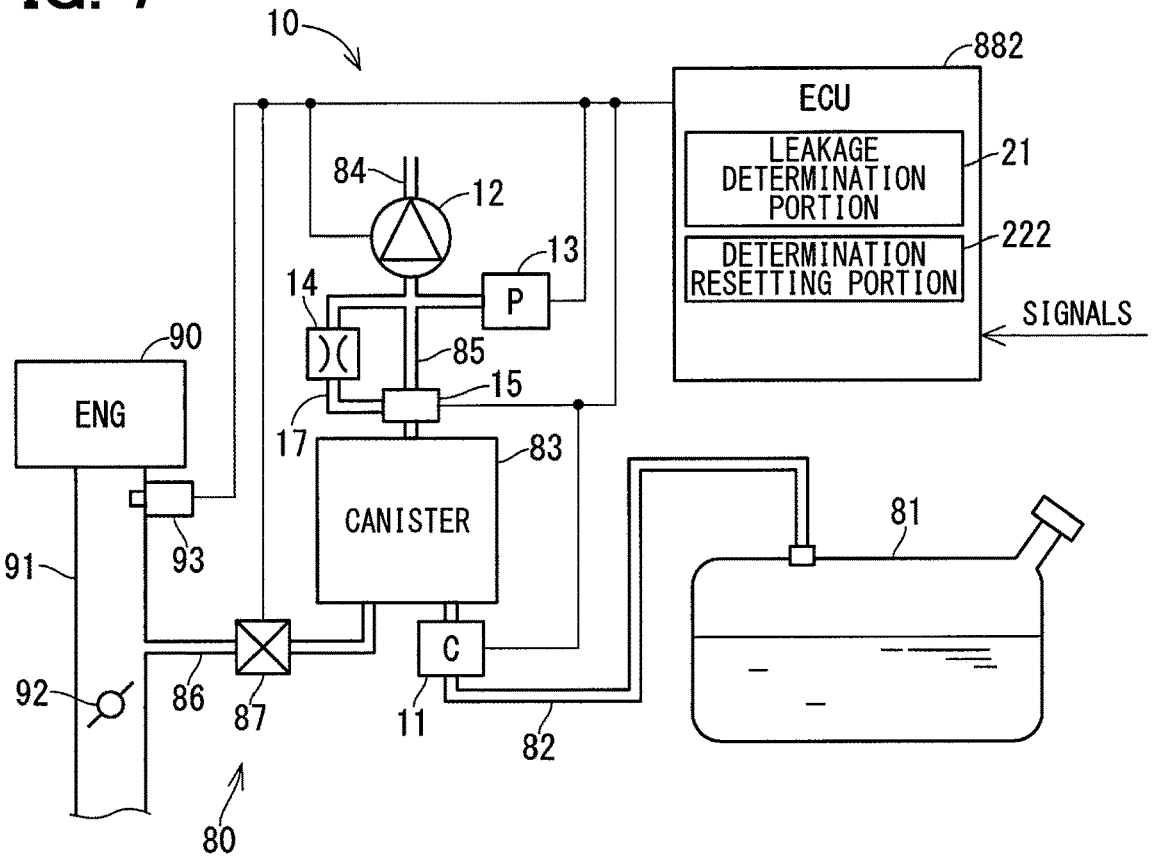
FIG. 7 is a schematic diagram of a leakage detecting device for vaporized fuel according to a second embodiment of the present disclosure.

As shown in FIG. 7, an ECU 882 of a second embodiment has a determination resetting portion 222, which is different from that of the first embodiment. The determination resetting portion 222 stops the leakage determination process of the leakage determination portion 21, when the time-variable amount of the density becomes larger than a determination-stop threshold value during the leakage determination process to be carried out by the leakage determination portion 21. In the second embodiment, the determination-stop threshold value is set at such a value equal to the upper-limit value "THu" for the density determination. In addition, the determination resetting portion 222 stops the leakage determination process of the leakage determination portion 21, when an engine rotational speed of the engine 90 exceeds a predetermined rotational value during the leakage determination process of the leakage determination portion 21, or when an operating time of the engine 90 exceeds a predetermined operating time during the leakage determination process of the leakage determination portion 21.

The predetermined rotational value and the predetermined operating time are obtained in advance through, for example, experiments and/or simulations or the like. Each of the predetermined rotational value and the predetermined operating time is obtained as such a value or a time, with which the detection accuracy for the leakage determination may be decreased as a result that the operation of the vaporized fuel processing system 80 becomes unstable.

(Process Implemented by ECU)

Figure 8:
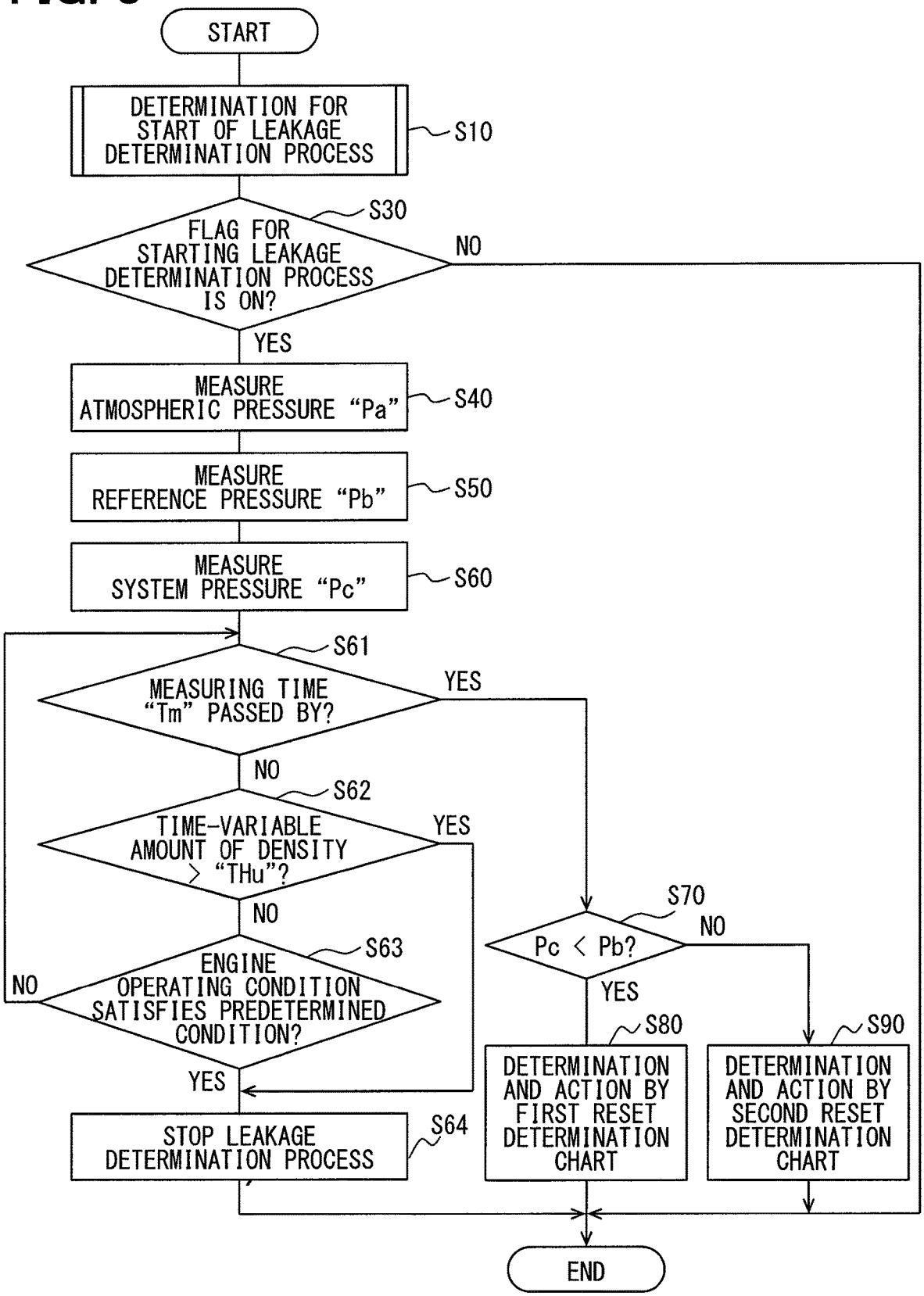
FIG. 8 is a flow-chart of a main routine showing a leakage determination and resetting process to be carried out by the electronic control unit of the second embodiment.

A process implemented by the ECU 882 for detecting the leakage of the vaporized fuel will be explained with reference to FIG. 8. The steps S10 to S60 as well as the steps S70 to S90 of the main routine shown in FIG. 8 are the same to those of the first embodiment (FIG. 5). At a step S61 of FIG. 8, the ECU 882 determines whether a predetermined measuring time "Tm" has passed by or not. When the predetermined measuring time "Tm" has passed by (YES at the step S61), the process goes to the step S70. When the predetermined measuring time "Tm" has not yet passed by (NO at the step S61), the process goes to a step S62.

At the step S62, the ECU 882 determines whether the time-variable amount of the density becomes larger than the determination-stop threshold value (equal to the upper-limit value "THu" for the density determination) or not. When the time-variable amount of the density becomes larger than the determination-stop threshold value (YES at the step S62), the process goes to a step S64. On the other hand, when the time-variable amount of the density is smaller than the determination-stop threshold value (NO at the step S62), the process goes to a step S63.

At the step S63, the ECU 882 determines whether the operating condition of the engine 90 satisfies a predetermined operating condition or not. More exactly, the ECU 882 determines whether the rotational speed of the engine 90 exceeds the predetermined rotational value or whether the operating time of the engine 90 exceeds the predetermined operating time. When the operating condition of the engine 90 satisfies the predetermined operating condition (YES at the step S63), the process goes to the step S64. On the other hand, when the operating condition of the engine 90 does not satisfy the predetermined operating condition (NO at the step S63), the process goes back to the step S61.

At the step S64, the operation of the pump 12 as well as the operation of the first and the second sensors 11 and 13 is stopped in order that the leakage determination process of the leakage determination portion 21 is stopped. The process goes to the end after the step S64.

(Advantages)

In the second embodiment, the leakage determination process of the leakage determination portion 21 is stopped, when the time-variable amount of the density becomes larger than the determination-stop threshold value (YES at the step S62) or when the operating condition of the engine satisfies the predetermined operating condition (YES at the step S63). It is thereby possible to avoid an erroneous determination for the leakage determination of the vaporized fuel, which may be caused by disturbance. In addition, since the structure and/or the function of the second embodiment are the same to those of the first embodiment except for the above explained points (the steps S61 to S64), the second embodiment can obtain the substantially same advantages to those of the first embodiment.

Third Embodiment

Figure 9:
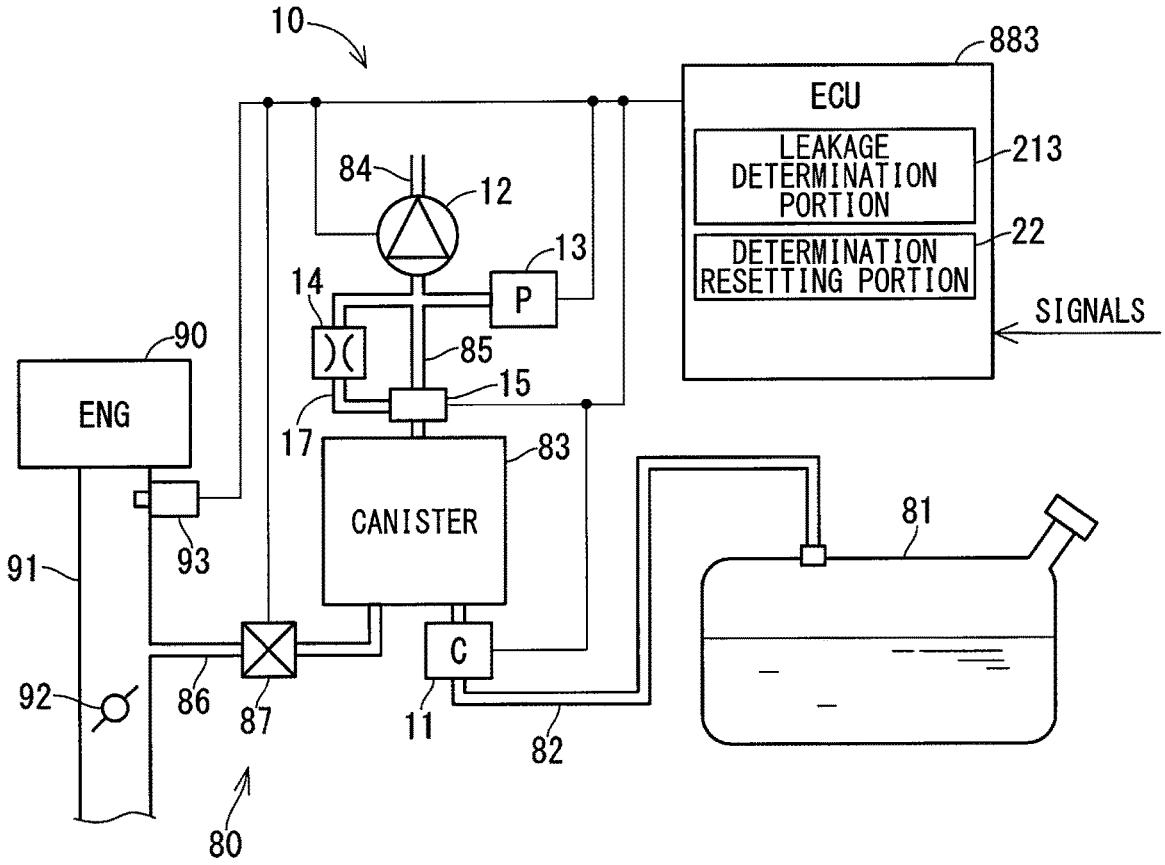
FIG. 9 is a schematic diagram of a leakage detecting device for vaporized fuel according to a third embodiment of the present disclosure.

As shown in FIG. 9, an ECU 883 of the leakage detecting device 10 according to a third embodiment includes a leakage determination portion 213, which is different from that of the first embodiment. The present embodiment is preferably applied to the hybrid vehicle.

The leakage determination portion 213 starts the leakage determination process when the operation of the engine 90 is stopped during a running of the automotive vehicle and when a remaining amount of battery energy for a vehicle driving motor (not shown) is larger than a predetermined value. The operation of the engine 90 is stopped during the running of the automotive vehicle (the hybrid vehicle), for example, when a gear of a transmission apparatus is in a neutral position while the automotive vehicle is running by the vehicle driving motor.

(Process Implemented by ECU)

Figure 10:
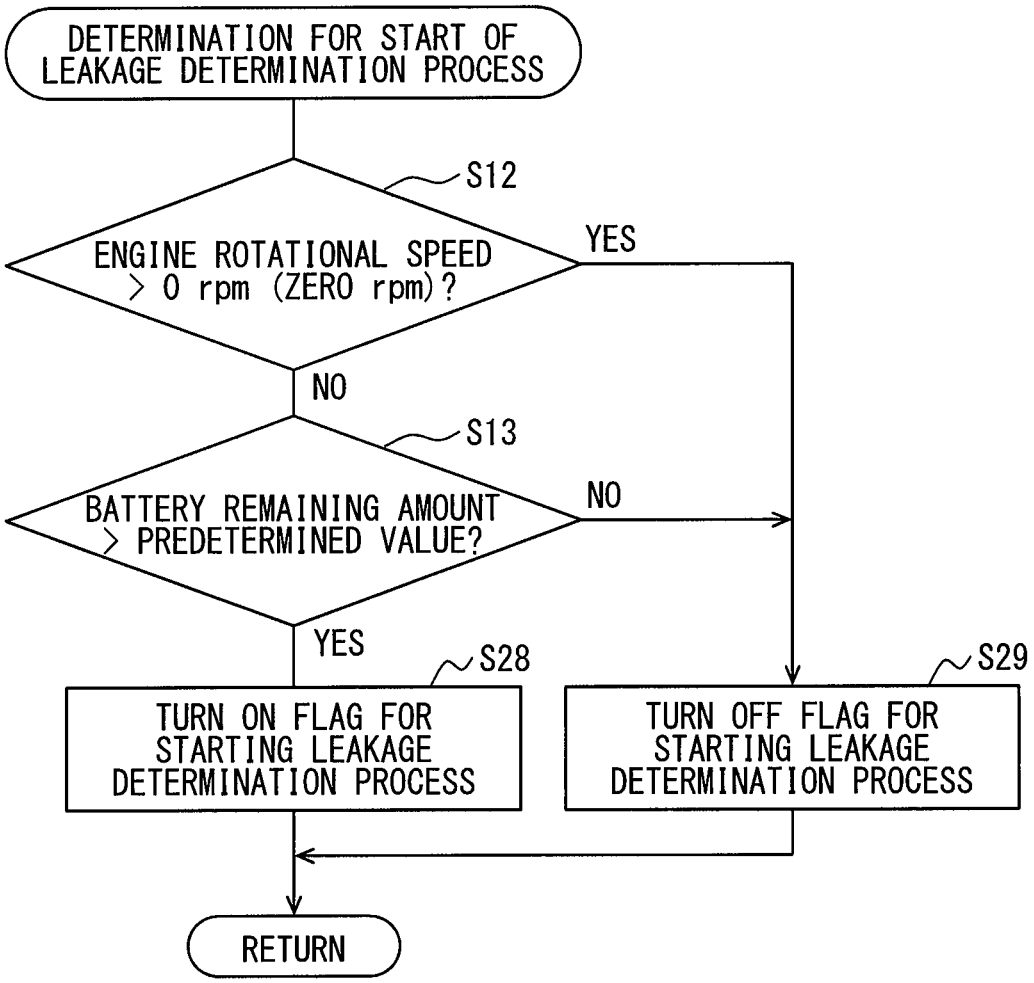
FIG. 10 is a flow-chart of a sub-routine showing a process for determining whether the leakage determination and resetting process is started or not by the electronic control unit of the third embodiment.

A process implemented by the ECU 883 for detecting the leakage of the vaporized fuel will be explained with reference to FIG. 10. The steps S28 and S29 of the sub-routine shown in FIG. 10 are the same to those of the first embodiment (FIG. 6). When the step S10 of the main routine (FIG. 5) is carried out, the sub-routine of FIG. 10 is implemented. At a step S12, the ECU 883 determines whether the engine rotational speed is larger than a predetermined value "0 rpm (zero rpm)" or not, during the running of the automotive vehicle. When the engine rotational speed is larger than the predetermined value "0 rpm (zero rpm)", namely, when the engine operation is not stopped (YES at the step S12), the process goes to the step S29. On the other hand, when the engine rotational speed is equal to the predetermined value "0 rpm (zero rpm)", namely, when the engine operation is stopped (NO at the step S12), the process goes to a step S13.

At the step S13, the ECU 883 determines whether the remaining amount of the battery energy for the vehicle driving motor is larger than the predetermined value or not. When the remaining amount of the battery energy is larger than the predetermined value (YES at the step S13), the process goes to the step S28. On the other hand, when the remaining amount of the battery energy is smaller than the predetermined value (NO at the step S13), the process goes to the step S29. The process goes back to the step S10 (FIG. 5) and the main routine of FIG. 5 is continuously carried out after the step S28 or S29.

(Advantages)

In the third embodiment, the leakage determination portion 213 of the ECU 883 starts the leakage determination process when the operation of the engine 90 is stopped during the running of the automotive vehicle and when the remaining amount of the battery energy for the vehicle driving motor is larger than the predetermined value. As above, since the leakage determination process is carried out in the condition that the operating condition of the vaporized fuel processing system 80 is stable, it is possible to improve the leakage detection accuracy for the vaporized fuel. In addition, since the structure and/or the function of the third embodiment are the same to those of the first embodiment except for the above explained points (the steps S12 and S13), the third embodiment can also obtain the substantially same advantages to those of the first embodiment.

Fourth Embodiment

Figure 11:
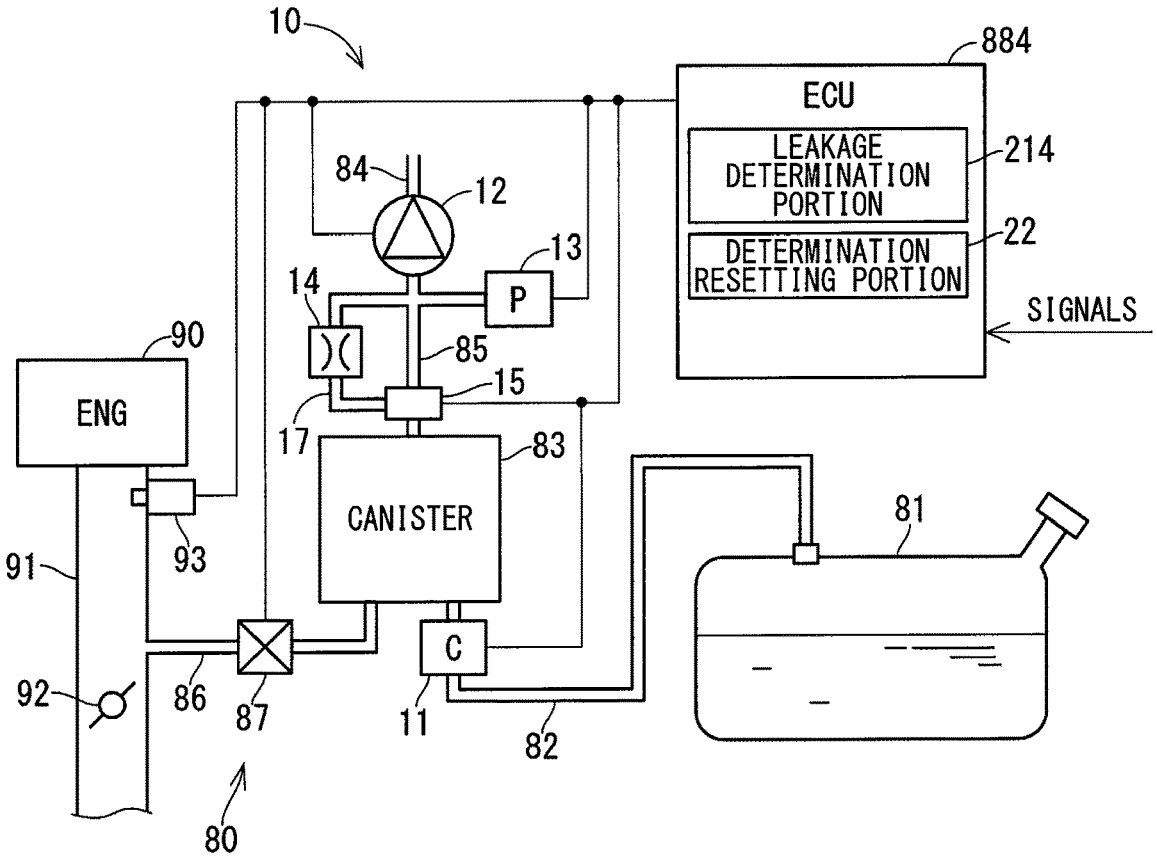
FIG. 11 is a schematic diagram of a leakage detecting device for vaporized fuel according to a fourth embodiment of the present disclosure.

As shown in FIG. 11, an ECU 884 of the leakage detecting device 10 according to a fourth embodiment includes a leakage determination portion 214, which is different from that of the first embodiment. The leakage determination portion 214 starts the leakage determination process immediately after a main power supply to the automotive vehicle is turned off (for example, an engine starting switch is turned off). The signals, which the ECU 884 receives, include a signal for indicating an ON-condition or an OFF-condition of the main electric power supply to the automotive vehicle.

(Process Implemented by ECU)

Figure 12:
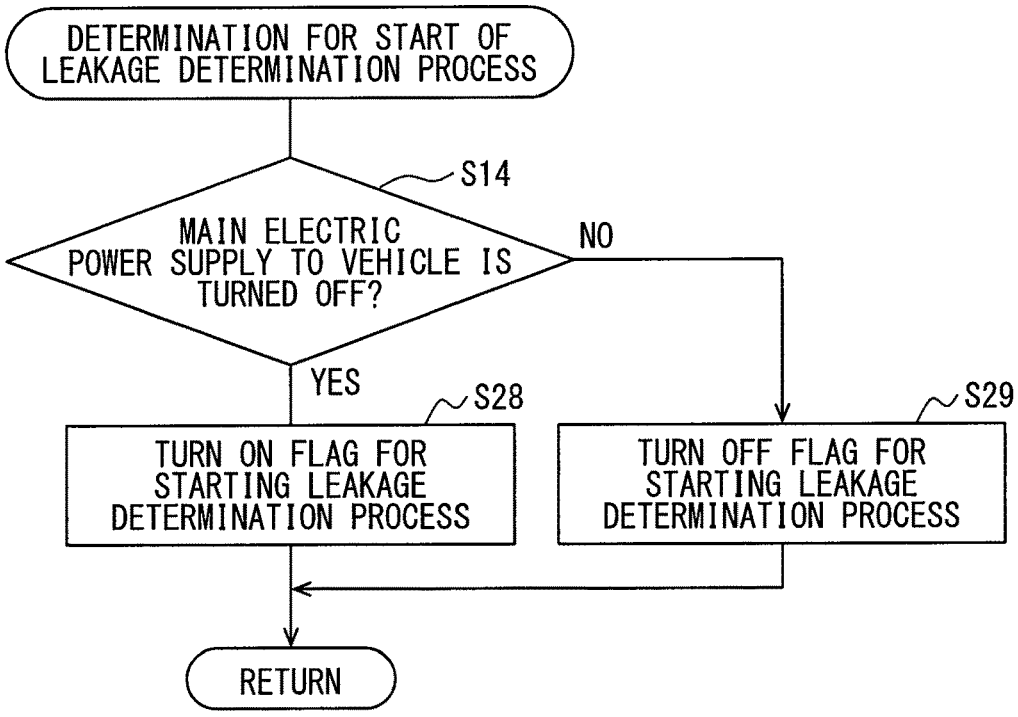
FIG. 12 is a flow-chart of a sub-routine showing a process for determining whether the leakage determination and resetting process is started or not by the electronic control unit of the fourth embodiment.

A process implemented by the ECU 884 for detecting the leakage of the vaporized fuel will be explained with reference to FIG. 12. The steps S28 and S29 of FIG. 12 are the same to those of the first embodiment (FIG. 6). When the step S10 of the main routine (FIG. 5) is carried out, the sub-routine of FIG. 12 is implemented. At a step S14, the ECU 884 determines whether the main electric power supply to the automotive vehicle is turned OFF or not. When the main electric power supply to the automotive vehicle is turned OFF (YES at the step S14), the process goes to the step S28. On the other hand, when the main electric power supply to the automotive vehicle is not yet turned OFF, namely, when the main electric power supply to the automotive vehicle is in the ON-condition (NO at the step S14), the process goes to the step S29. The main routine of the process of FIG. 5 is continuously carried out after the step S28 or S29.

(Advantages)

In the fourth embodiment, the leakage determination portion 214 of the ECU 884 can start the leakage determination process immediately after the main electric power supply to the automotive vehicle is turned off. It was necessary in the prior art to wait for a predetermined time when starting the leakage determination process. For example, the leakage determination process is started when about five hours have passed by after the main power supply to the automotive vehicle is turned off. In the present embodiment, however, it is possible to broaden the range of the operating conditions of the engine and/or the automotive vehicle for carrying out the leakage determination process, because the leakage determination process can be started immediately after the main electric power supply to the automotive vehicle is turned off. In addition, since the structure and/or the function of the fourth embodiment are the same to those of the first embodiment except for the above explained point (the step S14), the fourth embodiment can also obtain the substantially same advantages to those of the first embodiment.

Fifth Embodiment

Figure 13:
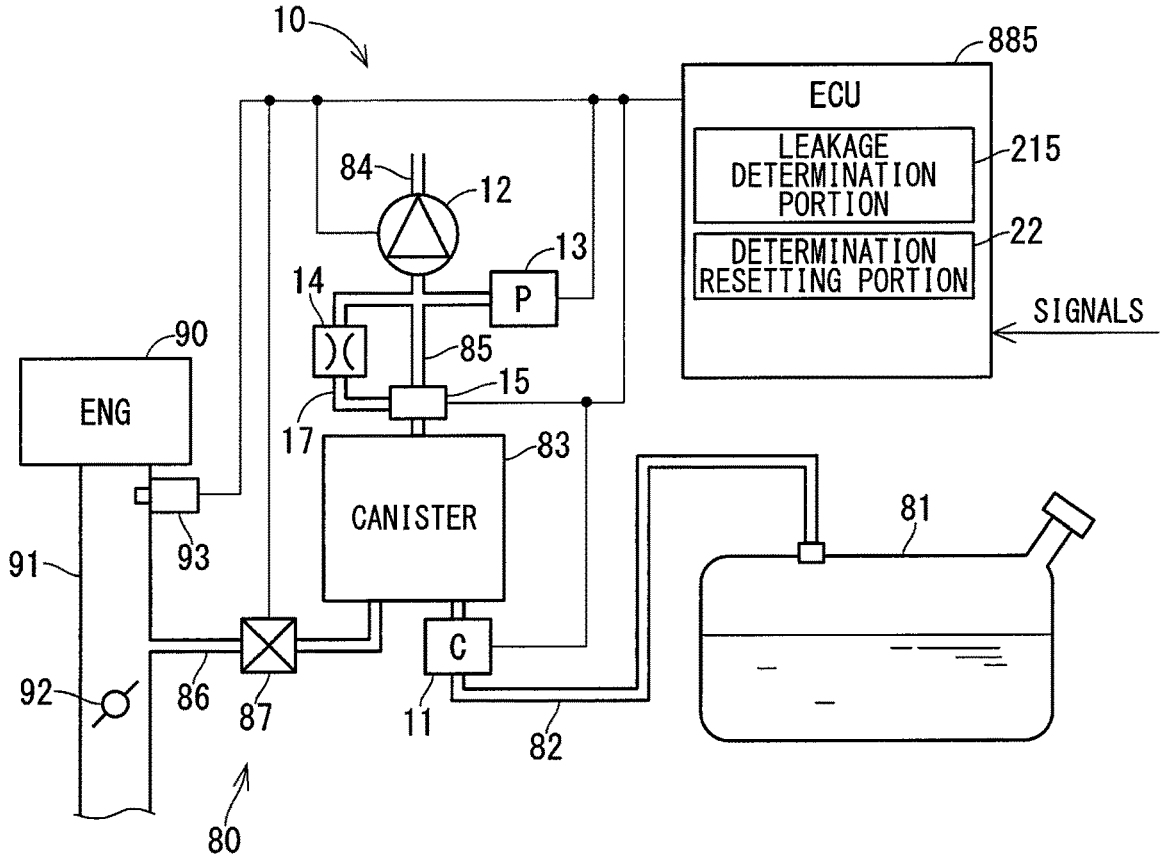
FIG. 13 is a schematic diagram of a leakage detecting device for vaporized fuel according to a fifth embodiment of the present disclosure.

As shown in FIG. 13, an ECU 885 of the leakage detecting device 10 according to a fifth embodiment includes a leakage determination portion 215, which is different from that of the first embodiment. The present embodiment is preferably applied to the hybrid vehicle. The leakage determination portion 215 starts the leakage determination process during a battery for the vehicle driving motor (the vehicle driving battery) is being charged. The signals, which the ECU 885 receives, include a signal for indicating a battery charging condition of the battery for the vehicle driving motor.

(Process Implemented by ECU)

Figure 14:
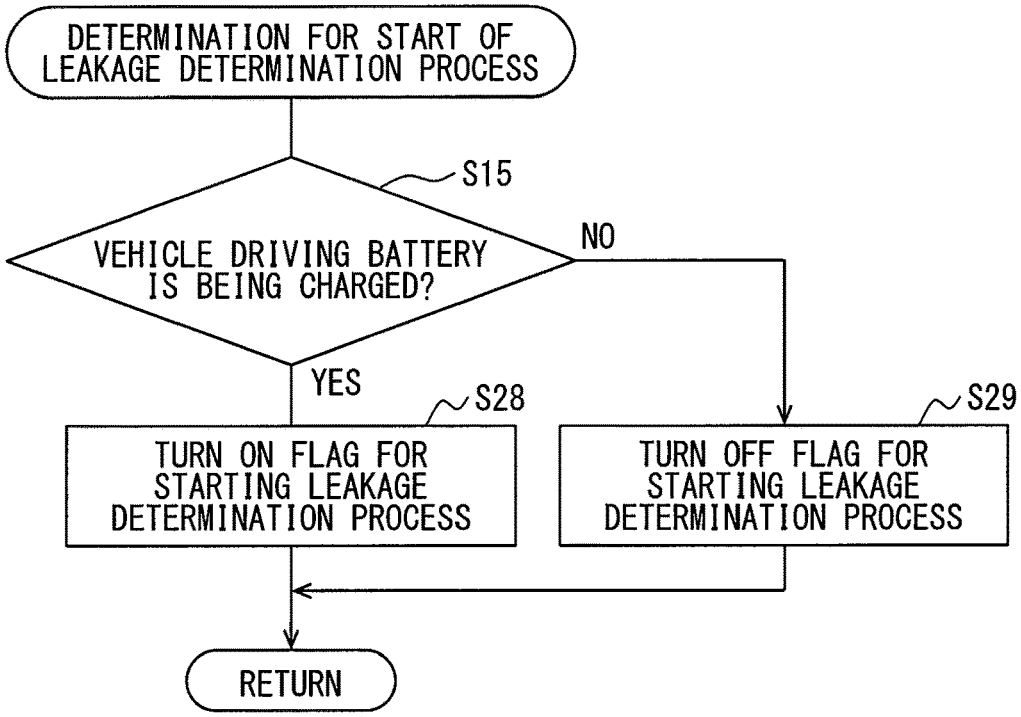
FIG. 14 is a flow-chart of a sub-routine showing a process for determining whether the leakage determination and resetting process is started or not by the electronic control unit of the fifth embodiment.

A process implemented by the ECU 885 for detecting the leakage of the vaporized fuel will be explained with reference to FIG. 14. The steps S28 and S29 of FIG. 14 are the same to those of the first embodiment (FIG. 6). When the step S10 of the main routine shown in FIG. 5 is carried out, the sub-routine of FIG. 14 is implemented. At a step S15, the ECU 885 determines whether the battery for the vehicle driving motor is being charged or not. When the battery for the vehicle driving motor is being charged (YES at the step S15), the process goes to the step S28. On the other hand, when the battery for the vehicle driving motor is not being charged (NO at the step S15), the process goes to the step S29. The main routine shown in FIG. 5 is continuously carried out after the step S28 or S29 of FIG. 14.

(Advantages)

In the fifth embodiment, the leakage determination portion 215 of the ECU 885 starts the leakage determination process during the battery for the vehicle driving motor is being charged. Since it is possible to carry out the leakage determination process by use of an outside electric power other than that of the battery for the vehicle driving motor, the battery energy for the vehicle driving motor is not consumed for the leakage determination process. In addition, since the structure and/or the function of the fifth embodiment are the same to those of the first embodiment except for the above explained point (the step S15), the fifth embodiment can likewise obtain the substantially same advantages to those of the first embodiment.

Sixth Embodiment

Figure 15:
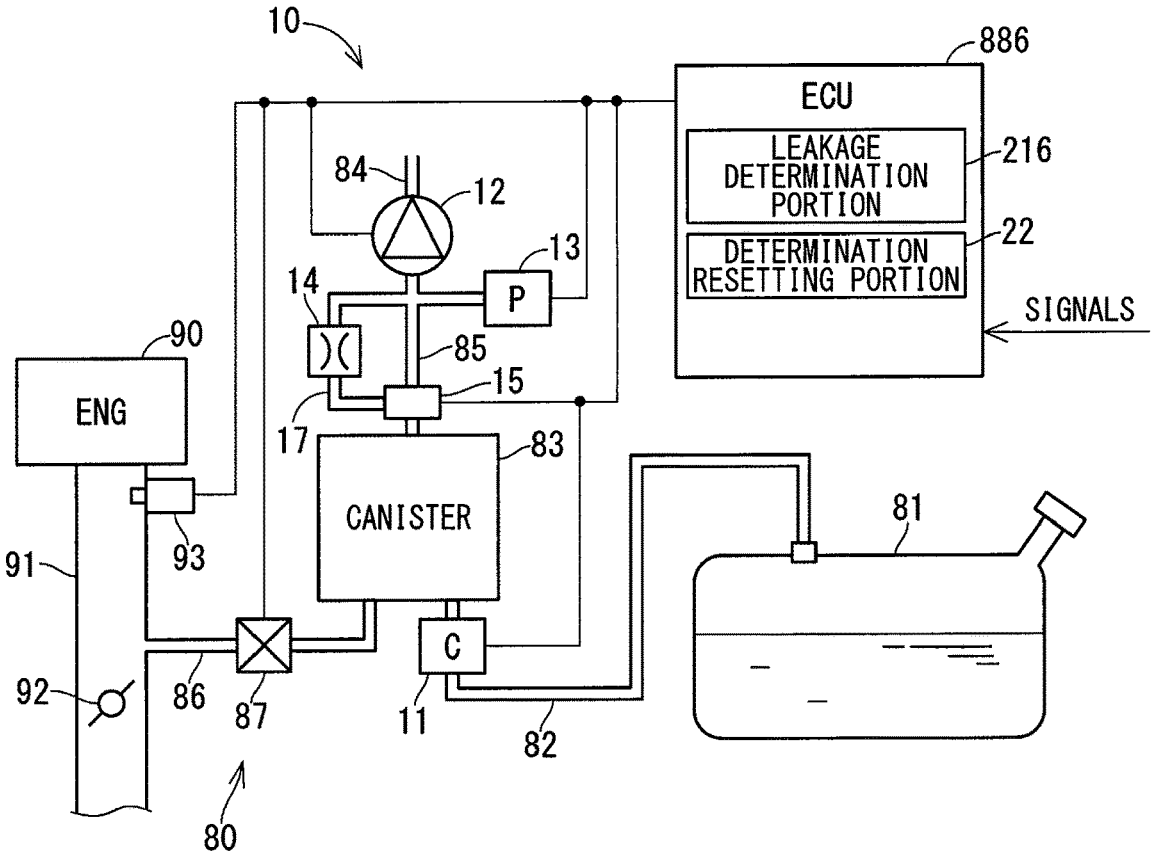
FIG. 15 is a schematic diagram of a leakage detecting device for vaporized fuel according to a sixth embodiment of the present disclosure.

As shown in FIG. 15, an ECU 886 of the leakage detecting device 10 according to a sixth embodiment includes a leakage determination portion 216, which is different from that of the first embodiment. The leakage determination portion 216 determines whether the automotive vehicle is in a normal running condition or not, based on a cruise-control signal and/or information from a car navigation system. When the leakage determination portion 216 determines that the automotive vehicle is in the normal running condition, the ECU 886 starts the leakage determination process. For example, the information from the car navigation system includes such information for a current vehicle position, a designated position, a recommended route to the designated position and so on. The leakage determination portion 216 determines that the automotive vehicle is in the normal running condition, for example, when the automotive vehicle is running on a high way. The signals, which the ECU 886 receives, include the cruise-control signal and/or the information from the car navigation system.

(Process Implemented by ECU)

Figure 16:
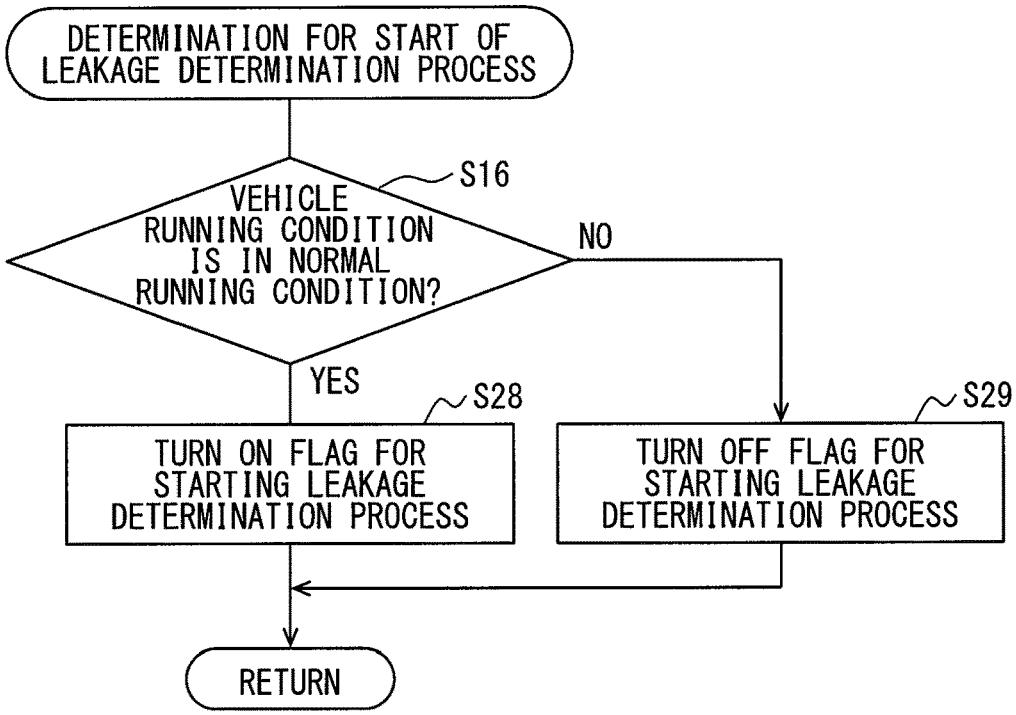
FIG. 16 is a flow-chart of a sub-routine showing a process for determining whether the leakage determination and resetting process is started or not by the electronic control unit of the sixth embodiment.

A process implemented by the ECU 886 for detecting the leakage of the vaporized fuel will be explained with reference to FIG. 16. The steps S28 and S29 of FIG. 16 are the same to those of the first embodiment (FIG. 6). When the step S10 of the main routine shown in FIG. 5 is carried out, the sub-routine of FIG. 16 is implemented. At a step S16, the ECU 886 determines whether the automotive vehicle is in the normal running condition or not, based on the cruise-control signal and/or the information from the car navigation system. When the automotive vehicle is in the normal running condition (YES at the step S16), the process goes to the step S28. On the other hand, when the automotive vehicle is not in the normal running condition (NO at the step S16), the process goes to the step S29. The main routine of FIG. 5 is continuously carried out after the step S28 or S29 of FIG. 16.

(Advantages)

In the sixth embodiment, the leakage determination portion 216 of the ECU 886 starts the leakage determination process when the automotive vehicle is in the normal running condition. Since the leakage determination process is carried out in the condition that the operating condition of the vaporized fuel processing system 80 is stable, it is possible to improve the leakage detection accuracy for the vaporized fuel. In addition, since the structure and/or the function of the sixth embodiment are the same to those of the first embodiment except for the above explained point (the step S16), the sixth embodiment can likewise obtain the substantially same advantages to those of the first embodiment.

Seventh Embodiment

Figure 17:
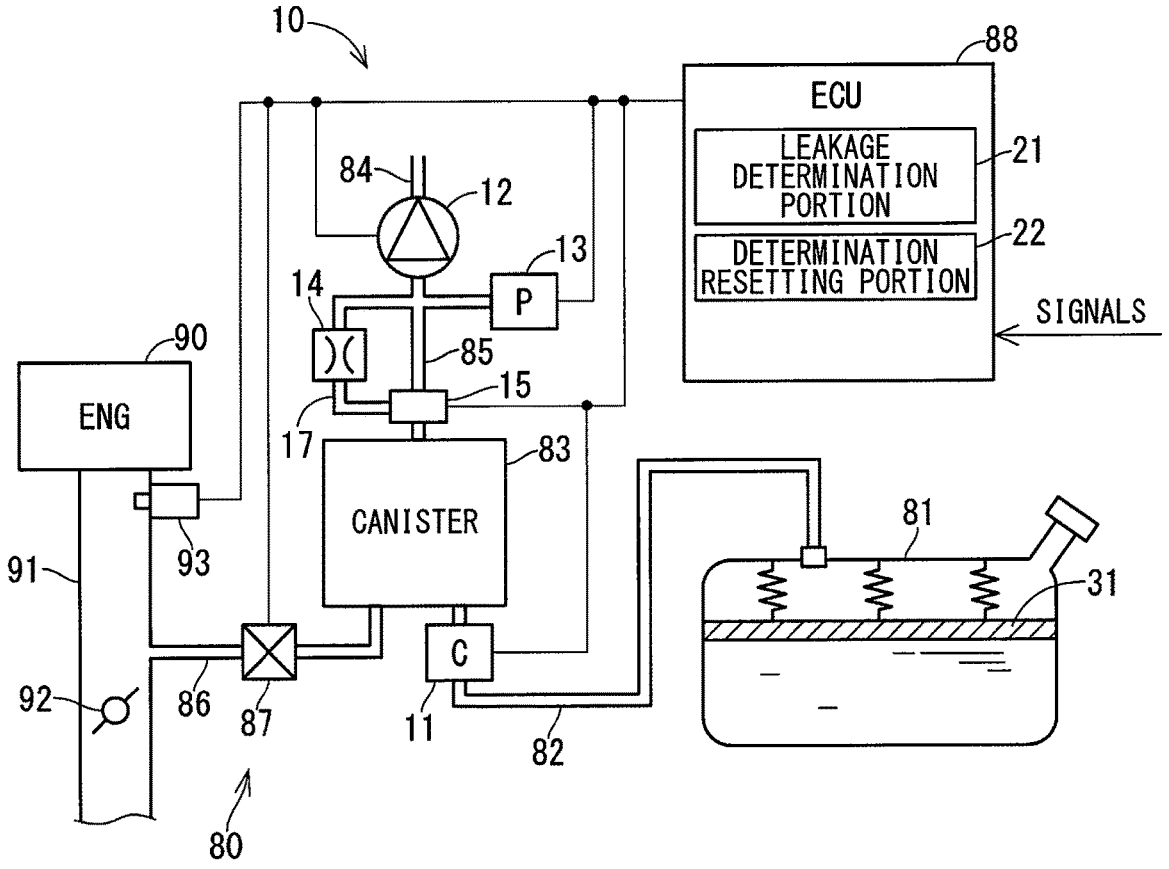
FIG. 17 is a schematic diagram of a leakage detecting device for vaporized fuel according to a seventh embodiment of the present disclosure.

As shown in FIG. 17, in the leakage detecting device 10 according to a seventh embodiment, an inside cover plate 31 is movably provided in the fuel tank 81. The inside cover plate 31 is in contact with a liquid surface of the fuel in the fuel tank 81, so that its height is changed depending on a liquid level. It is possible to prevent by the inside cover plate 31 vibration of the liquid surface, which may be caused by vibration of the automotive vehicle. As a result, it is possible to suppress large variation of the density in the fuel tank 81, to thereby broaden the range of the operating conditions of the engine and/or the automotive vehicle for carrying out the leakage determination process for the vaporized fuel.

Eighth Embodiment

Figure 18:
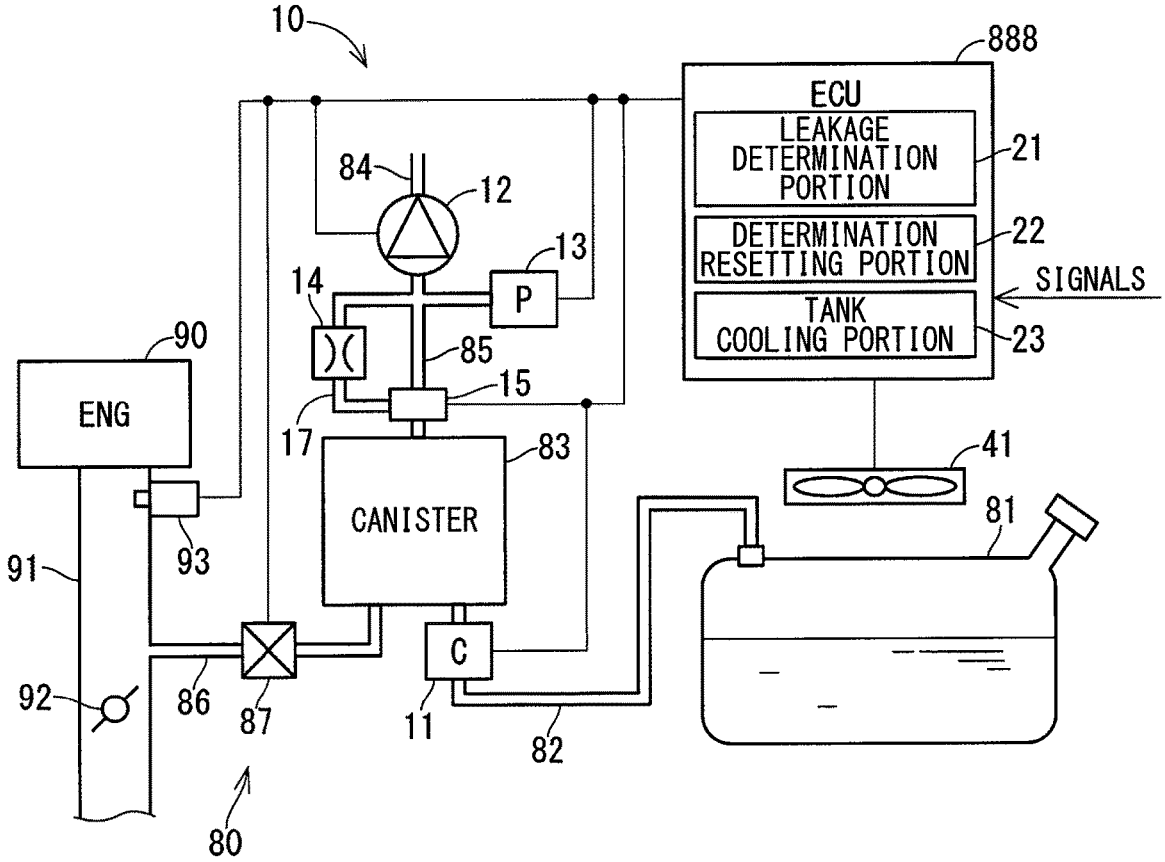
FIG. 18 is a schematic diagram of a leakage detecting device for vaporized fuel according to an eighth embodiment of the present disclosure.

As shown in FIG. 18, an ECU 888 of the leakage detecting device 10 according to an eighth embodiment includes a tank cooling portion 23. In addition, in the leakage detecting device 10 of the present embodiment, a cooling fan device 41 is provided, from which cooling air is supplied to the fuel tank 81. The tank cooling portion 23 starts an operation of the cooling fan device 41 when the time-variable amount of the density is larger than a cooling-start threshold value "THc" in order to cool down the fuel tank 81 by the cooling air from the cooling fan device 41.

(Process Implemented by ECU)

Figure 19:
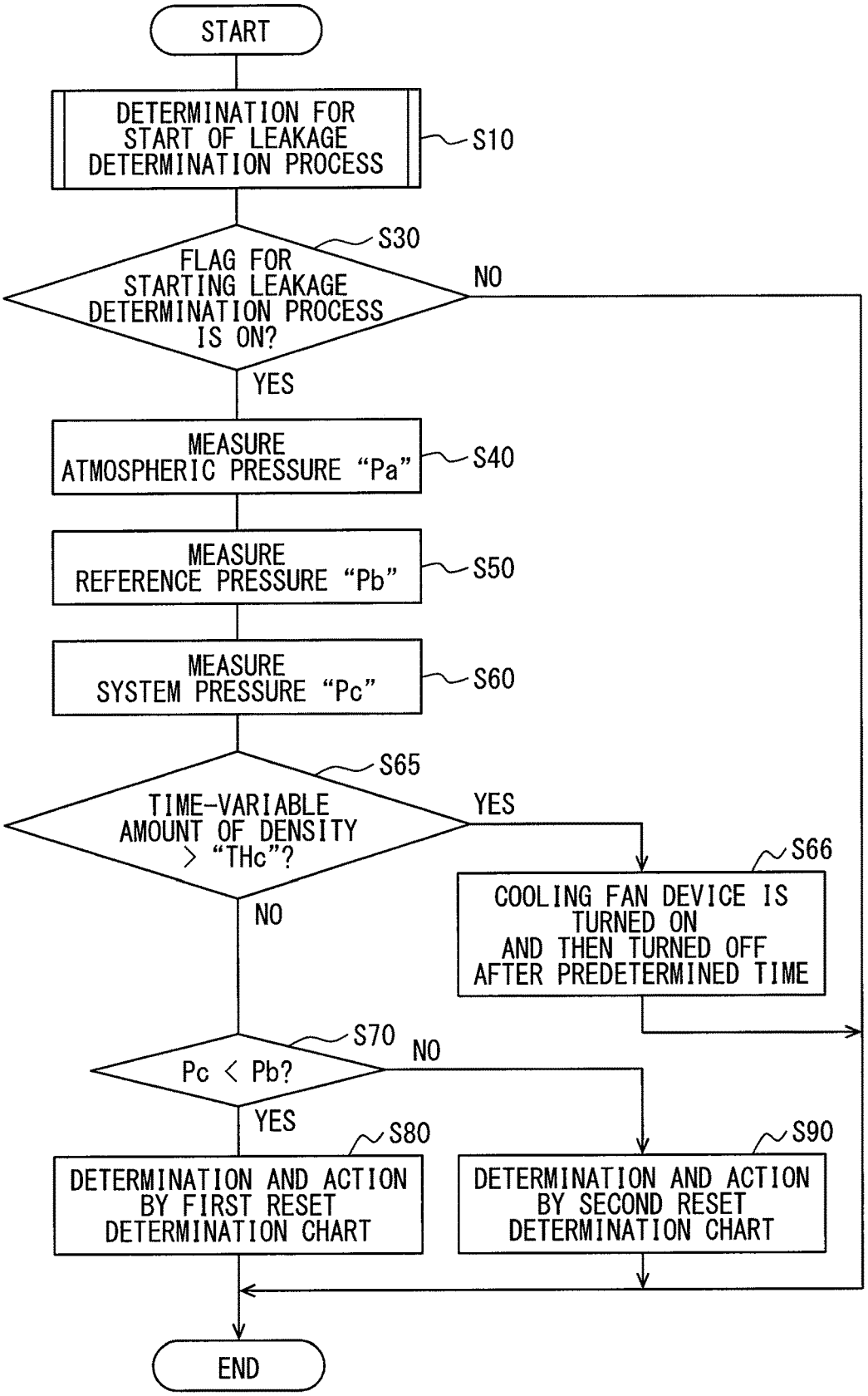
FIG. 19 is a flow-chart of a main routine showing a leakage determination and resetting process to be carried out by the electronic control unit of the eighth embodiment.

A process implemented by the ECU 888 for detecting the leakage of the vaporized fuel will be explained with reference to FIG. 19. The steps S10 to S60 as well as the steps S70 to S90 of a main routine shown in FIG. 19 are the same to those of the first embodiment (FIG. 5). At a step S65, which is carried out after the step S60, the ECU 888 determines whether the time-variable amount of the density is larger than the cooling-start threshold value "THc" or not. When the time-variable amount of the density is larger than the cooling-start threshold value "THc" (YES at the step S65), the process goes to a step S66. On the other hand, when the time-variable amount of the density is not larger than the cooling-start threshold value "THc" (NO at the step S65), the process goes to the step S70.

At the step S66, the cooling fan device 41 is turned ON. The cooling fan device 41 is then turned OFF after a predetermined time has passed by and the process goes to the end.

(Advantages)

In the eighth embodiment, the tank cooling portion 23 starts the operation of the cooling fan device 41 when the time-variable amount of the density is larger than the cooling-start threshold value "THc", to thereby cool down the fuel tank 81. The vaporized fuel processing system 80 is stabilized when the temperature of the fuel tank 81 is decreased, so that the range of the operating conditions of the engine and/or the automotive vehicle for carrying out the leakage determination process is broadened. In addition, since the structure and/or the function of the eighth embodiment are the same to those of the first embodiment except for the above explained points (the steps S65 and S66), the eighth embodiment can likewise obtain the substantially same advantages to those of the first embodiment.

Ninth Embodiment

Figure 20:
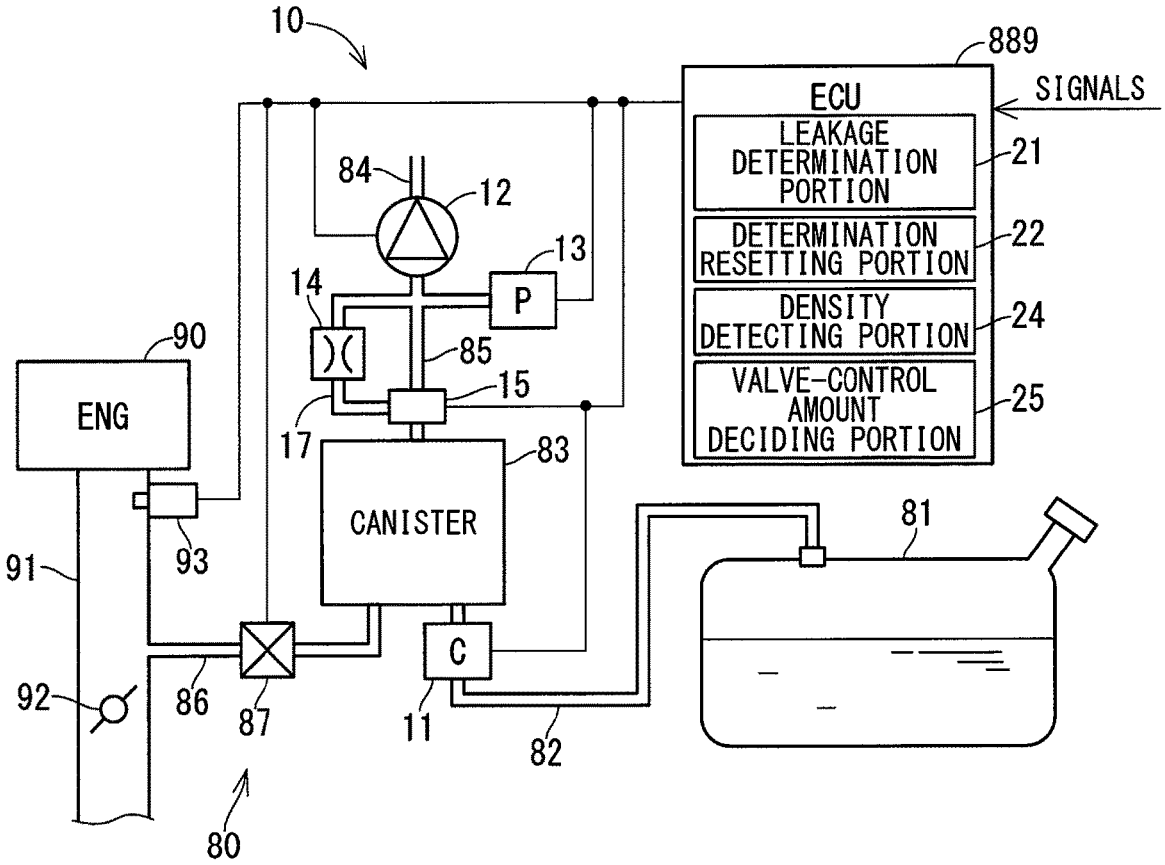
FIG. 20 is a schematic diagram of a leakage detecting device for vaporized fuel according to a ninth embodiment of the present disclosure.
Figure 21:
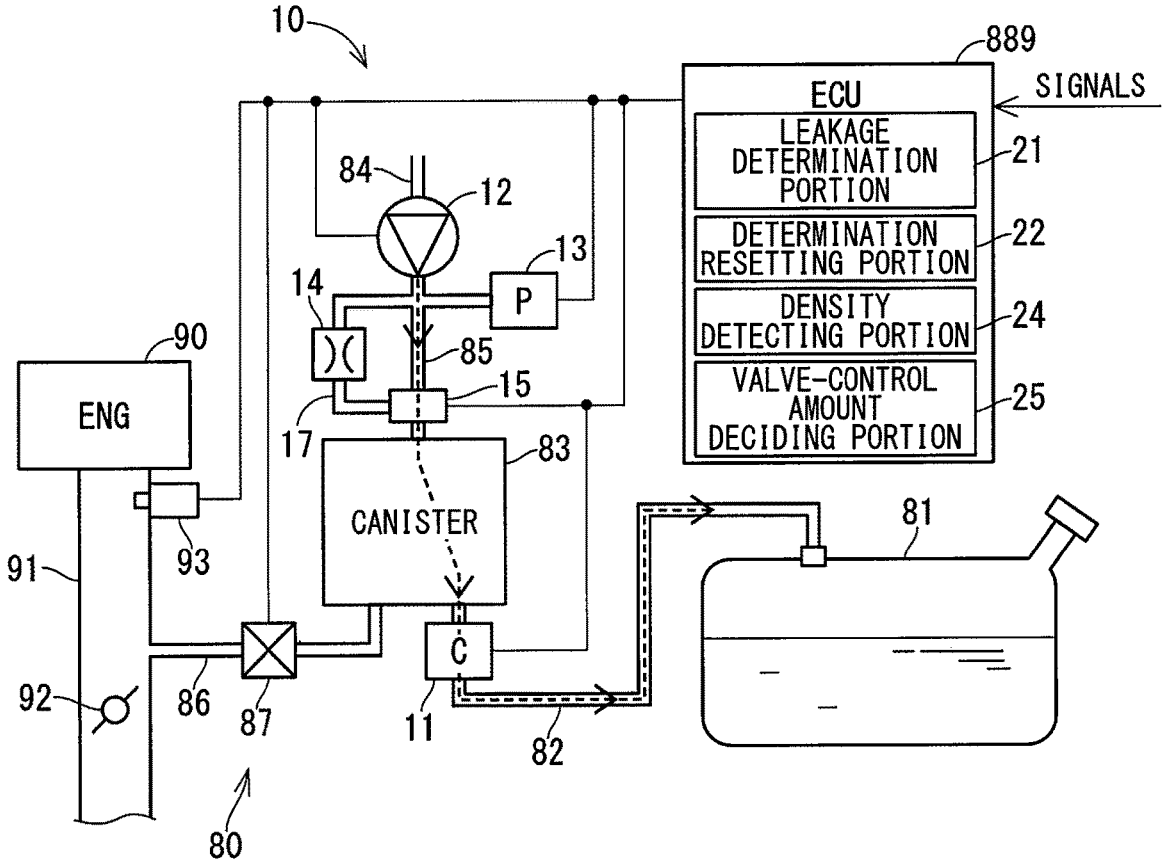
FIG. 21 is the schematic diagram of the leakage detecting device for vaporized fuel according to the ninth embodiment, wherein a pump is rotated in a backward direction.

As shown in FIG. 20, an ECU 889 of the leakage detecting device 10 according to a ninth embodiment includes a density detecting portion 24 and a valve-control amount deciding portion 25. The density detecting portion 24 detects the density of the vaporized fuel in the canister 83 by rotating the pump 12 in the backward direction to increase the pressure in the canister 83, as indicated by a dotted line in FIG. 21, when the time-variable amount of the density is larger than a purge-start threshold value "THp". The valve-control amount deciding portion 25 decides a control amount of the purge valve device 87 depending on the density of the vaporized fuel in the canister 83 and outputs a command signal to the vaporized fuel processing system 80. The vaporized fuel processing system 80 carries out the purge control by operating the purge valve device 87 in accordance with the control amount of the command signal.

When the purge control is carried out in the above manner, the condition in the fuel tank 81 is stabilized. It is thereby possible to broaden the range of the operating condition of the engine and/or the automotive vehicle for carrying out the leakage determination process. Since the density of the vaporized fuel in the canister 83 is used for the purge control, it is possible to effectively carry out the purging operation.

Tenth Embodiment

Figure 22:
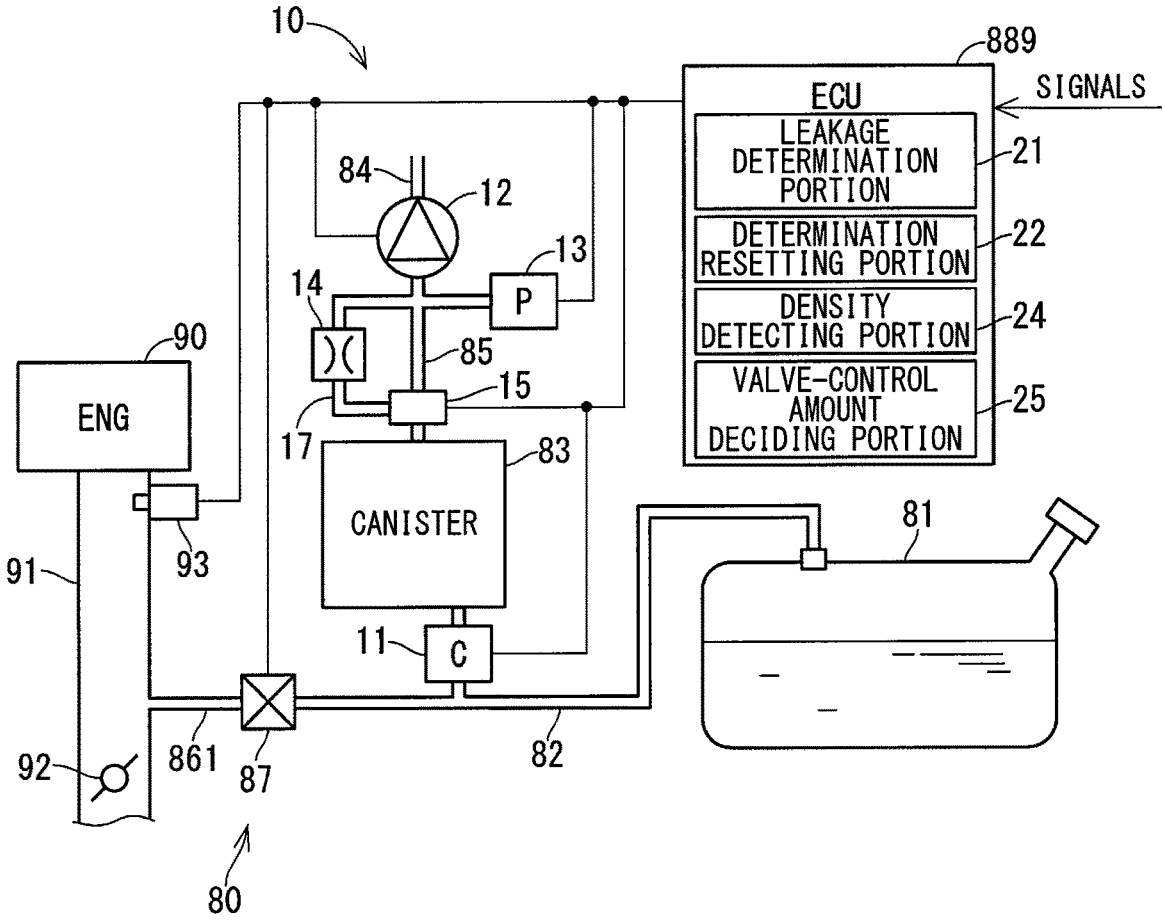
FIG. 22 is a schematic diagram of a leakage detecting device for vaporized fuel according to a tenth embodiment of the present disclosure.

As shown in FIG. 22, in the leakage detecting device 10 according to a tenth embodiment, a purge passage 861 is connected to the vaporized fuel collecting passage 82, without passing through the canister 83. In FIG. 22, the first sensor 11 is provided in the vaporized fuel collecting passage 82. However, the first sensor 11 may be provided in the purge passage 861 on a side closer to the purge valve device 87 (that is, at a position between the purge valve device 87 and the vaporized fuel collecting passage 82). Since the purge passage 861 and the first sensor 11 are provided as above, it is possible to more precisely detect the density of the vaporized fuel, when the density of the vaporized fuel in the canister 83 is detected by the density detecting portion 24.

Figure 23:
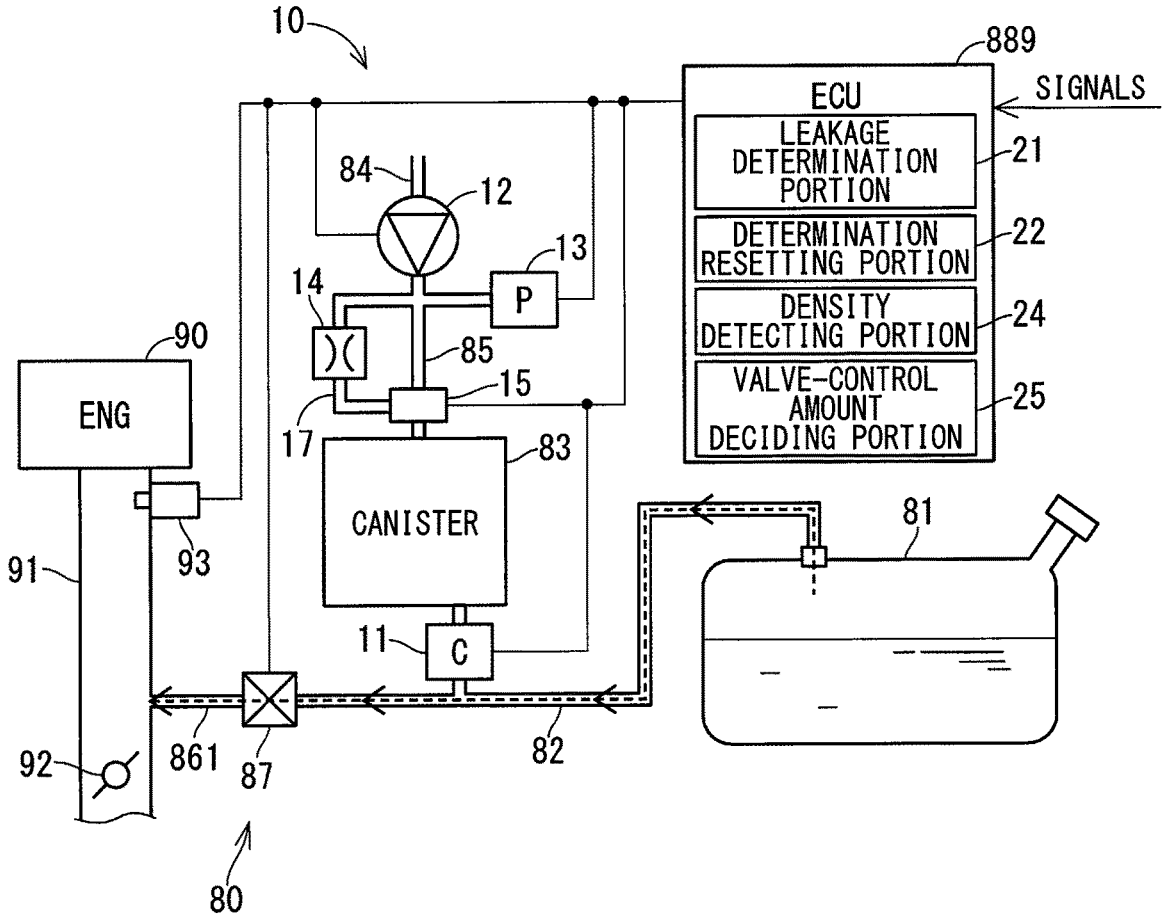
FIG. 23 is the schematic diagram of the leakage detecting device for vaporized fuel according to the tenth embodiment, wherein the vaporized fuel generated in a fuel tank is purged to an internal combustion engine.
Figure 24:
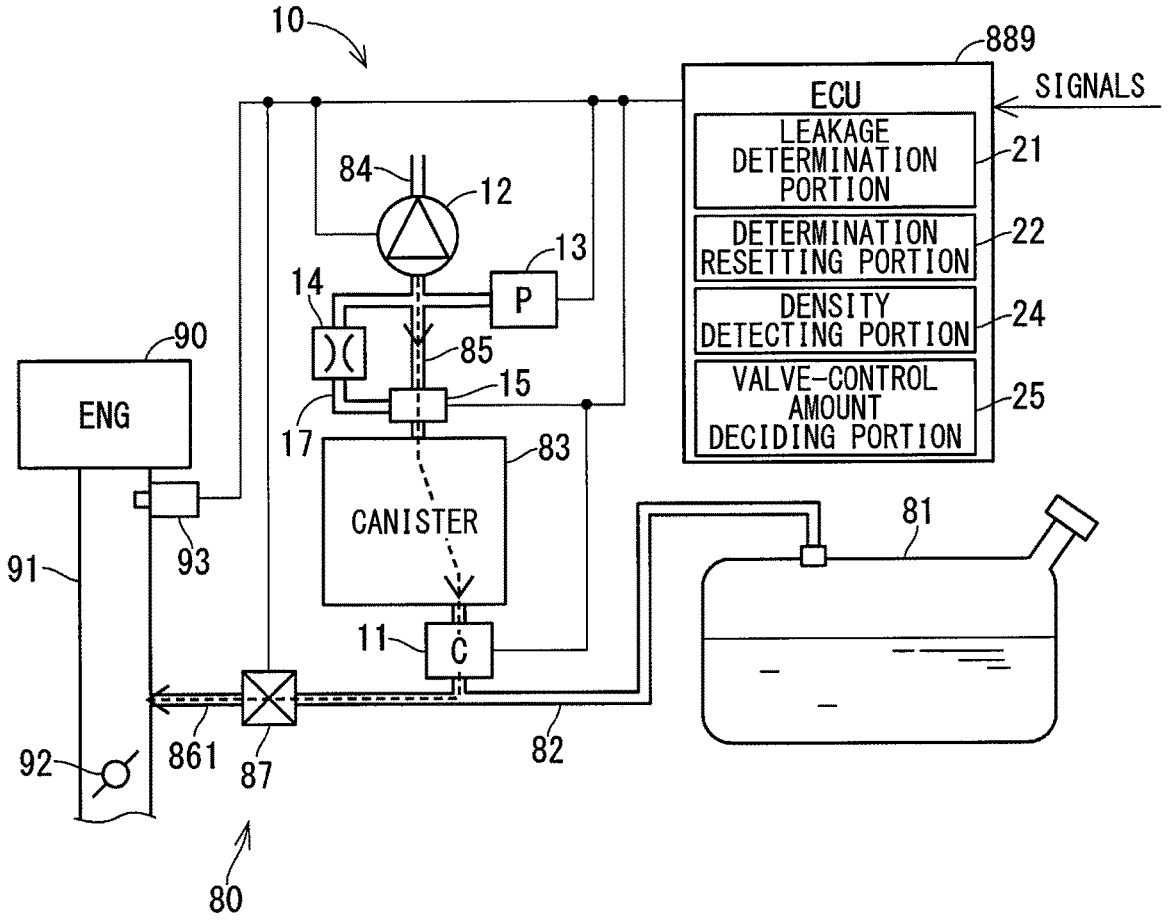
FIG. 24 is the schematic diagram of the leakage detecting device for vaporized fuel according to the tenth embodiment, wherein the vaporized fuel collected in a canister is purged to the internal combustion engine.

In the vaporized fuel processing system 80 of the tenth embodiment, it is possible to selectively carry out the purging operation of the vaporized fuel from the fuel tank 81 (as indicated by a dotted line in FIG. 23) and the purging operation of the vaporized fuel from the canister 83 (as indicated by a dotted line in FIG. 24). In the purging operation shown in FIG. 23, the passage switching valve 15 is closed during the engine operation, while the purge valve device 87 is opened. The vaporized fuel is thereby sucked from the fuel tank 81 by the negative pressure in the intake air pipe 91. In the purging operation shown in FIG. 24, not only the passage switching valve 15 is opened during the engine operation but also the purge valve device 87 is opened. The vaporized fuel is sucked from the canister 83 by the negative pressure in the intake air pipe 91.

Further Embodiments and/or Modifications

The first physical amount is not limited to the density of the vaporized fuel. For example, an amount of the vaporized fuel or a flow rate of the vaporized fuel may be used as the first physical amount. Each of the above first to the tenth embodiments may be combined with the other embodiment(s) of the present disclosure.

In the above embodiments, it is not always necessary to provide the restricted passage 17, the orifice 14 or the passage switching valve 15. In such a modification, the reference pressure is not measured. Instead, the leakage determination process is carried out by comparing the system pressure with a threshold value for the no-leakage condition, which is set in advance.

The present disclosure is not limited to the above embodiments and/or the modifications but can be further modified in various manners without departing from a spirit of the present disclosure.

What is claimed is:

1. A leakage detecting device for a vaporized fuel processing system which comprises;

a canister for storing vaporized fuel generated in a fuel tank; and a purge valve device for controlling an amount of the vaporized fuel to be supplied from the canister into an internal combustion engine of an automotive vehicle, wherein the leakage detecting device comprises;

(a) a first sensor provided in a first passage connecting the fuel tank to the canister or in a second passage connecting the purge valve device to the canister or to the first passage, the first sensor measuring a first physical amount related to a gas existing at a position at which the first sensor is provided;

(b) a pump provided in a third passage connecting the canister to an atmospheric passage;

(c) a second sensor provided in the third passage at a position between the canister and the pump, the second sensor measuring a second physical amount related to a gas existing at a position at which the second sensor is provided;

(d) a leakage determination portion for determining whether there is a leakage of the vaporized fuel in the vaporized fuel processing system based on a time-variable amount of the second physical amount; and (e) a determination resetting portion for cancelling a leakage determination result made by the leakage determination portion or stopping a leakage determination process to be carried out by the leakage determination portion, based on a time-variable amount of the first physical amount and the time-variable amount of the second physical amount.

2. The leakage detecting device according to claim 1, wherein the determination resetting portion stops the leakage determination process of the leakage determination portion, when the time-variable amount of the first physical amount becomes larger than a determination-stop threshold value during a period in which the leakage determination process is carried out by the leakage determination portion.

3. The leakage detecting device according to claim 2, wherein the determination resetting portion stops the leakage determination process of the leakage determination portion, when an engine rotational speed of the internal combustion engine becomes larger than a predetermined rotational value, or when an engine operating time becomes larger than a predetermined operating time, during the period in which the leakage determination process is carried out by the leakage determination portion.

4. The leakage detecting device according to claim 1, wherein the determination resetting portion cancels the leakage determination result made by the leakage determination portion, when the time-variable amount of the second physical amount is larger than a threshold value for a no-leakage condition, and when the time-variable amount of the first physical amount is larger than an upper-limit value for density determination or smaller than a lower-limit value for the density determination, and the determination resetting portion further cancels the leakage determination result made by the leakage determination portion, when the time-variable amount of the second physical amount is smaller than the threshold value for the no-leakage condition, and when the time-variable amount of the first physical amount is larger than the upper-limit value for the density determination.

5. The leakage detecting device according to claim 1, wherein the first physical amount is one of the following amounts;

a density of the vaporized fuel;

an amount of the vaporized fuel; and a flow rate of the vaporized fuel.

6. The leakage detecting device according to claim 1, wherein the pump is connected to the canister via the third passage or a fourth passage, an orifice is provided in the fourth passage, and a passage switching valve is provided in the fourth passage for switching a passage condition from a first passage condition to a second passage condition, or vice versa, wherein, in the first passage condition, the canister is connected to the pump via the third passage, and wherein, in the second passage condition, the canister is connected to the pump via the fourth passage.

7. The leakage detecting device according to claim 1, wherein the leakage determination portion starts the leakage determination process, when an operation of the internal combustion engine is stopped during a running condition of the automotive vehicle, and when a remaining battery energy for a vehicle driving battery is larger than a predetermined value.

8. The leakage detecting device according to claim 1, wherein the leakage determination portion starts the leakage determination process immediately after a main electric power supply to the automotive vehicle is turned off.

9. The leakage detecting device according to claim 1, wherein the leakage determination portion starts the leakage determination process during a period, in which a vehicle driving battery for a vehicle driving motor is being charged.

10. The leakage detecting device according to claim 1, wherein the leakage determination portion starts the leakage determination process, when the leakage determination portion determines based on a signal from a cruise control device and/or a car navigation system that a vehicle running condition is in a normal running condition.

11. The leakage detecting device according to claim 1, wherein an inside cover plate is movably provided in the fuel tank in such a manner that the inside cover plate is in contact with a liquid surface of fuel in the fuel tank so that a position of the inside cover plate is changed in accordance with a liquid level of the fuel in the fuel tank.

12. The leakage detecting device according to claim 1, further comprising;

a cooling fan device for supplying cooling air to the fuel tank; and a tank cooling portion for driving the cooling fan device in order to cool down the fuel tank, when the time-variable amount of the first physical amount is larger than a cooling-start threshold value.

13. The leakage detecting device according to claim 1, further comprising;

a density detecting portion for detecting density of the vaporized fuel in the canister by rotating the pump in such a direction that pressure in the canister is increased, when a time-variable amount of the first physical amount is larger than a purge-start threshold value; and a valve-control amount deciding portion for deciding a control amount for the purge valve device based on the density of the vaporized fuel in the canister and outputting a command signal to the vaporized fuel processing system.

14. The leakage detecting device according to claim 1, wherein the fuel tank is connected to the canister via the first passage, the second passage, in which the purge valve device is provided, is connected to the first passage without passing through the canister, and the first sensor is provided in the first passage or in the second passage at a position between the purge valve device and the first passage.

* * * * *